US006867552B2

(12) United States Patent
Takamori et al.

(10) Patent No.: US 6,867,552 B2
(45) Date of Patent: Mar. 15, 2005

(54) METHOD OF DRIVING PLASMA DISPLAY DEVICE AND PLASMA DISPLAY DEVICE

(75) Inventors: Takahiro Takamori, Kawasaki (JP); Noriaki Setoguchi, Higashimorokata (JP); Eiji Ito, Kawasaki (JP); Tomokatsu Kishi, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 0 days.

(21) Appl. No.: 09/986,949

(22) Filed: Nov. 13, 2001

(65) Prior Publication Data

US 2002/0097003 A1 Jul. 25, 2002

(30) Foreign Application Priority Data

Jan. 19, 2001 (JP) ..... 2001-012417

(51) Int. Cl.[7] ..... G09G 3/10

(52) U.S. Cl. ..... 315/169.4; 315/169.1; 315/169.2; 345/67

(58) Field of Search ..... 315/169.1, 169.2, 315/169.3, 169.4; 345/60, 62, 65, 67, 68; G09G 3/10

(56) References Cited

U.S. PATENT DOCUMENTS

| | | | | |
|---|---|---|---|---|
| 5,420,602 A | | 5/1995 | Kanazawa | |
| 5,446,344 A | * | 8/1995 | Kanazawa | 315/169.4 |
| 6,034,482 A | * | 3/2000 | Kanazawa et al. | 315/169.4 |
| 6,084,558 A | | 7/2000 | Setoguchi et al. | |
| 6,124,849 A | | 9/2000 | Ito et al. | 315/169.4 |
| 6,522,314 B1 | * | 2/2003 | Tomio et al. | 345/68 |
| 6,528,952 B2 | * | 3/2003 | Kato et al. | 315/169.4 |
| 6,538,392 B2 | * | 3/2003 | Kanazawa | 315/169.4 |

FOREIGN PATENT DOCUMENTS

| | | |
|---|---|---|
| CN | 1254153 A | 5/2000 |
| EP | 0 965 975 A1 | 12/1999 |
| EP | 1 065 650 A2 | 1/2001 |
| JP | 2000-75835 | 3/2000 |

OTHER PUBLICATIONS

Patent Abstracts of Japan of JP 11–338414 dated Dec. 10, 1999.

* cited by examiner

*Primary Examiner*—Tho Phan
(74) *Attorney, Agent, or Firm*—Staas & Halsey LLP

(57) ABSTRACT

After a sustain discharge period, a voltage twice a sustain pulse is applied to one of sustain discharge electrodes to form, on an address electrode, wall charges capable of self-erase discharge between an address electrode and the sustain discharge electrode by an address pulse, and the address pulse is applied to the address electrode to perform self-erase discharge between the address electrode and the sustain discharge electrode, thereby removing the wall charges formed on the address electrode. With this arrangement, a cell to be turned on in accordance with display data can be accurately selected in an address period without forming any wall charges on the address electrode, and any degradation in drive margin or display quality of a plasma display device can be suppressed.

24 Claims, 19 Drawing Sheets

METHOD OF DRIVING PLASMA DISPLAY DEVICE AND PLASMA DISPLAY DEVICE

CROSS-REFERENCE TO RELATED APPLICATIONS

This application is based upon and claims priority of Japanese Patent Application No. 2001-12417, filed on Jan. 19, 2001, the contents being incorporated herein by reference.

BACKGROUND OF THE INVENTION

1. Field of the Invention

The present invention relates to a method of driving a plasma display device and a plasma display device and, more particularly, to a method of driving a three-electrode surface-discharge plasma display device.

2. Description of the Related Art

AC-driven plasma display panels (PDPs) have conventionally received a great deal of attention as next-generation displays replacing CRTs because the PDPs are self-emission-type displays excellent in visibility and they also allow display on large thin screens. Particularly, surface-discharge PDPs are expected as displays compatible with high-definition digital broadcasting due to their larger screen size and are required to have an image quality higher than CRTs.

AC-driven PDPs are classified into two-electrode type PDPs which perform selective discharge (address discharge) and sustain discharge using two electrodes and three-electrode type PDPs which perform address discharge using a third electrode. The three-electrode types PDPs are further classified into a type with the third electrode formed on a substrate on which the first and second electrodes for performing sustain discharge are laid out and a type with the third electrode formed on another substrate opposite to the substrate of the first and second electrodes.

All types of the above PDP devices are based on the same operation principle. The arrangement of a PDP device in which the first and second electrodes for performing sustain discharge are formed on the first substrate, and the third electrode is formed on said second substrate opposite to the first substrate will be described below.

FIG. 10 is a view showing the overall arrangement of an AC-driven PDP device. In the AC-driven PDP device shown in FIG. 10, a plurality of cells each corresponding to one pixel of a display image are arrayed in a matrix. FIG. 10 shows an AC-driven PDP device having cells arrayed in a matrix with m rows by n columns. The AC-driven PDP also has scanning electrodes Y1 to Yn and common electrodes X, which are formed to run parallel on the first substrate, and address electrodes A1 to Am which are formed on said second substrate opposite to the first substrate so as to run perpendicular to the electrodes Y1 to Yn and X. The common electrodes X are formed in proximities of the scanning electrodes Y1 to Yn in correspondence with them and commonly connected at terminals on one side.

The common terminal of the common electrodes X is connected to the output terminal of an X-side circuit 2. The scanning electrodes Y1 to Yn are connected to the output terminals of a Y-side circuit 3. The address electrodes A1 to Am are connected to the output terminals of an address-side circuit 4. The X-side circuit 2 is formed from a circuit for repeating discharge. The Y-side circuit 3 is formed from a circuit for performing line-sequential scanning and a circuit for repeating discharge. The address-side circuit 4 is formed from a circuit for selecting a column to be displayed.

The X-side circuit 2, Y-side circuit 3, and address-side circuit 4 are controlled by control signals supplied from a drive control circuit 5. That is, a cell to be turned on is determined by the address-side circuit 4 and the line-sequential scanning circuit in the Y-side circuit 3, and discharge repeats itself by the X-side circuit 2 and Y-side circuit 3, thereby performing the display operation of the PDP.

The control circuit 5 generates the control signals on the basis of display data D from an external device, a clock CLK indicating the read timing of the display data D, a horizontal sync signal HS, and a vertical sync signal VS and supplies the control signals to the X-side circuit 2, Y-side circuit 3, and address-side circuit 4.

FIG. 11A is a sectional view of a cell Cij as a pixel, which is in the ith row and jth column. Referring to FIG. 11A, the common electrode X and the scanning electrode Yi are formed on a front glass substrate 11. The electrodes are coated with a dielectric layer 12 that insulates the electrodes from a discharge space 17. The dielectric layer 12 is coated with an MgO (magnesium oxide) protective film 13.

On the other hand, the address electrode Aj is formed on a back glass substrate 14 opposite to the front glass substrate 11. The address electrode Aj is coated with a dielectric layer 15, and the dielectric layer 15 is coated with a phosphor 18. Ne+Xe Penning gas is sealed in the discharge space 17 between the MgO protective film 13 and the dielectric layer 15.

FIG. 11B is a view for explaining the capacitance of a cell that performs sustain discharge in the AC-driven PDP. As shown in FIG. 11B, in the AC-driven PDP, capacitive components Ca, Cb, and Cc are present in the discharge space 17, between the common electrode X and the scanning electrode Y, and in the front glass substrate 11, respectively. A capacitance Cpcell per cell between sustain discharge electrodes is determined by the sum of the capacitive components (Cpcell=Ca+Cb+Cc). The sum of capacitances Cpcell of cells between all sustain discharge electrodes corresponds to the capacitance of the cells that perform sustain discharge in the entire panel.

FIG. 11C is a view for explaining light emission of the AC-driven PDP. As shown in FIG. 11C, stripe-shaped red, blue, and green phosphors 18 are laid out and applied to the inner surfaces of ribs 16. The phosphors 18 are excited by discharge between the common electrode X and the scanning electrode Y so as to emit light.

FIG. 12 is a timing chart showing a conventional method of driving an AC-driven PDP. This timing chart shows a so-called "address/sustain-discharge-period-separation-type write address scheme". In the timing chart of FIG. 12, one of a plurality of subfields of one frame is shown. One subfield is divided into a reset period comprised of a full write period and full erase period, an address period, and a sustain discharge period.

In the reset period, all the scanning electrodes Y1 to Yn are set at ground level (0 V), and simultaneously, a full write pulse having a voltage Vs+Vw (about 400 V) is applied to the common electrodes X. At this time, all the address electrodes A1 to Am have a potential Vaw (about 100 V). Consequently, discharge occurs in all cells of all display lines to generate wall charges independently of the preceding display state.

Next, the potentials of the common electrodes X and address electrodes A1 to Am change to 0 V. As the voltage of wall charges themselves exceeds the discharge start voltage in all cells, discharge starts. In this discharge, no wall charges are formed because the electrodes have no potential difference. Space charges neutralize by themselves to end the discharge, i.e., so-called self-erase discharge occurs. With this self-erase discharge, all cells in the panel are set in a uniform state free from wall charges. The reset period acts to set all cells in the same state independently of the ON/OFF state of each cell in the preceding subfield. This makes it possible to stably perform the subsequent address (write) discharge.

In the address period, address discharge is line-sequentially performed to turn on/off each cell in accordance with display data. First, a voltage of −Vy level (about −150 V) is applied to the scanning electrode Y1 corresponding to the first display line, and a voltage of −Vsc level (about −50 V) is applied to the scanning electrodes Y2 to Yn corresponding to the remaining display lines. At the same time, an address pulse having a voltage Va (about 50 V) is selectively applied to the address electrode Aj corresponding to a cell which should cause sustain discharge, i.e., a cell to be turned on in the address electrodes A1 to Am.

As a result, discharge occurs between the scanning electrode Y1 and the address electrode Aj of the cell to be turned on. With this priming (pilot flame), discharge between the scanning electrode Y1 and the common electrode X having a voltage Vx (about 50 V) immediately starts. With this discharge, wall charges in an amount enough for the next sustain discharge are accumulated on the surface of the MgO protective film 13 on the common electrode X and scanning electrode Y1 of the selected cell. For the scanning electrodes Y2 to Yn corresponding to the remaining display lines as well, the voltage of −Vy is sequentially applied to a scanning electrode corresponding to a selected cell, and the voltage of −Vsc level is applied to a scanning electrode corresponding to each of remaining, unselected cells. With this processing, new display data is written in all display lines.

In the subsequent sustain discharge period, a sustain pulse having a voltage Vs (about 200 V) is alternately applied to the scanning electrodes Y1 to Yn and common electrodes X to perform sustain discharge so that an image of one subfield is displayed. In the "address/sustain-discharge-period-separation-type write address scheme", the luminance of the image is determined by the length of the sustain discharge period, i.e., the number of times of sustain pulse application.

FIG. 13 is a view showing the structure of one frame. FIG. 13 shows the structure of one frame for 16-level display as an example of grayscale display.

Referring to FIG. 13, one frame is formed from four subfields SF1, SF2, SF3, and SF4. The subfields SF1 to SF4 are comprised of reset periods RS1 to RS4, address periods AD1 to AD4, and sustain discharge periods SU1 to SU4, respectively. The reset periods RS1 to RS4 or address periods AD1 to AD4 of the subfields SF1 to SF4 have equal lengths.

The lengths of the sustain discharge periods SU1 to SU4 are set to SU1: SU2: SU3: SU4=1: 2: 4: 8. Hence, when a subfield in which cells are to be turned on is selected from the subfields SF1 to SF4, grayscale display with 16 gray levels from 0 to 15 can be performed. Note that the OFF period is a period without any drive waveform output.

FIGS. 14A and 14B are views showing the arrangement of a surface-discharge PDP. FIGS. 14A and 14B show the arrangement of a plasma display which causes discharge between all sustain discharge electrodes (X- and Y-electrodes) to display an image.

FIG. 14A is a schematic view showing the arrangement of a surface-discharge PDP. A surface-discharge PDP 20 has X-electrodes X1 to X5 and Y-electrodes Y1 to Y4, which are formed on one substrate to run parallel to each other, and address electrodes A1 to A6 which are formed on the other substrate to run perpendicular to the X-electrodes X1 to X5 and Y-electrodes Y1 to Y4. The surface-discharge PDP 20 has partitions 21 to 27 formed parallel to the address electrodes A1 to A6 to partition discharge spaces.

In this surface-discharge PDP 20, cells are formed in regions where the X-electrodes X1 to X5 and Y-electrodes Y1 to Y4 adjoin each other and the address electrodes A1 to A6 run perpendicular to the X- and Y-electrodes. The cells can be represented by display lines L1 to L8 between the sustain discharge electrodes (X- and Y-electrodes), as shown in FIG. 14A.

FIG. 14B is a sectional view of the surface-discharge PDP. FIG. 14B shows a section perpendicular to the X- and Y-electrodes and parallel to the address electrodes. Referring to FIG. 14B, reference numeral 28 denotes a back substrate on which the address electrodes are formed; and 29, a front substrate on which the X- and Y-electrodes are formed. As described above, in the surface-discharge PDP, cells are formed in regions where the X- and Y-electrodes adjoin each other and the address electrodes A1 to A6 run perpendicular to the X- and Y-electrodes, and discharge occurs in regions D1 to D3, as shown in FIG. 14B. That is, discharge is caused between all sustain discharge electrodes (X- and Y-electrodes) to display an image.

FIG. 15 is a view showing the structure of a frame of the surface-discharge PDP. FIG. 15 shows a frame structure when discharge is caused between all sustain discharge electrodes (X- and Y-electrodes) to display an image.

Referring to FIG. 15, one frame is formed from first and second fields. For example, display is performed on odd-numbered display lines in the first field and on even-numbered display lines in the second field, thereby displaying one frame. Each of the first and second fields has a plurality of (e.g., eight) subfields. Each subfield has the same frame structure as that shown in FIG. 13, and a description thereof will be omitted.

FIG. 16 is a timing chart showing an example of the drive waveforms of the surface-discharge PDP. FIG. 16 shows drive waveforms in the first field where discharge is performed between an X-electrode Xi and a Y-electrode Yi (i is an arbitrary integer) to display an image and, more specifically, drive waveforms in one of a plurality of subfields of the first field. One subfield is divided into a reset period comprised of a full write period and full erase period, an address period, and a sustain discharge period.

FIG. 16 shows the drive waveforms of an arbitrary address electrode A, X-electrodes X1 and X2, and Y-electrodes Y1 and Y2. For the remaining X- and Y-electrodes, each set of two X-electrodes and two Y-electrodes (X-electrode X3, Y-electrode Y3, X-electrode X4, and Y-electrode Y4), (X-electrode X5, Y-electrode Y5, X-electrode X6, and Y-electrode Y6), . . . is driven by the same drive waveforms as those shown in FIG. 16.

In the reset period, first, a voltage (−Vq) is applied to the X-electrodes X1 and X2, and a voltage Vws is applied to the Y-electrodes Y1 and Y2. With this operation, discharge occurs in all cells of all display lines to form wall charges independently of the preceding display state. At this time, the voltage applied to the Y-electrodes Y1 and Y2 has a waveform that continuously changes along with the elapse of time (this waveform will be referred to as a "ramp wave"

hereinafter). When such a ramp wave is applied, discharge sequentially occurs in cells that have reached the discharge voltage during the rise of the ramp wave. Actually, an optimum voltage (voltage almost equal to the discharge start voltage) is applied to each cell.

Next, the voltage Vx is applied to the X-electrodes X1 and X2, and a ramp wave whose final voltage is the voltage (−Vy) is applied to the Y-electrodes Y1 and Y2. As the voltage of wall charges themselves exceeds the discharge start voltage in all cells, discharge starts. At this time as well, weak discharge occurs in accordance with application of the ramp wave, so the accumulated wall charges are erased with some exceptions.

In the address period, address discharge is line-sequentially performed to turn on/off each cell in accordance with display data. The address period is divided into the first half portion and second half portion. At the first half portion in the address period, address discharge is performed for odd-numbered Y-electrodes. At the second half portion in the address period, address discharge is performed for even-numbered Y-electrodes.

In this address period, the voltage (−Vy) is applied to the Y-electrode selected for address discharge, and a voltage (−Vy+Vsc) is applied to the remaining Y-electrodes. At the same time, an address pulse having the voltage Va is selectively applied to the address electrode A corresponding to a cell which should cause sustain discharge, i.e., a cell to be turned on. As a result, discharge occurs between the Y-electrode and the address electrode A of the cell to be turned on. With this priming (pilot flame), discharge between the Y-electrode and the X-electrode having the voltage Vx starts, and wall charges in an amount enough for sustain discharge are accumulated.

FIG. 16 shows only address discharge for the Y-electrodes Y1 and Y2. At the first half portion in the address period, the Y-electrodes Y1, Y3, Y5, . . . are sequentially selected in this order for address discharge. At the second half portion in the address period, the Y-electrodes Y2, Y4, Y6, . . . are sequentially selected in this order for address discharge.

In the subsequent sustain discharge period, a sustain pulse having the voltage Vs is alternately applied to the X- and Y-electrodes at appropriate timings to perform sustain discharge, thereby displaying an image of one subfield.

However, to drive a surface-discharge PDP by the above-described drive method, drive voltages according to the timing chart shown in FIG. 16 must be applied to the respective electrodes, and each element of the surface-discharge PDP driving device must have a high breakdown voltage. For example, the circuit for applying the sustain pulse Vs shown in FIG. 16 to the X- and Y-electrodes must be constructed using elements having a very high breakdown voltage corresponding to the sustain pulse voltage.

As a solution to this problem, a surface-discharge PDP driving method has been proposed, in which in performing discharge between the sustain discharge electrodes of a surface-discharge PDP, a positive voltage is applied to one electrode, and a negative voltage is applied to the other electrode, thereby causing discharge between the electrodes using the potential difference between the electrodes without increasing the power consumption.

FIG. 17 is a timing chart showing an example of the drive waveforms of a surface-discharge PDP which performs discharge between electrodes using the potential difference between the electrodes. In the reset and address periods shown in FIG. 17, the X- and Y-electrodes have the same potential relationship as that shown in the timing chart of FIG. 16, and only the values of voltages to be applied to the electrodes are different.

In the sustain discharge period, voltages between (−Vs/2) and Vs/2 are applied to the X- and Y-electrodes. When the positive voltage Vs/2 is applied to one electrode, the negative voltage (−Vs/2) is applied to the other electrode. The potential difference between the X-electrode and the Y-electrode corresponds to the sustain pulse Vs shown in FIG. 16, so sustain discharge occurs between the sustain discharge electrodes (X- and Y-electrodes).

As described above, in the sustain discharge period, a positive voltage is applied to one electrode, and a negative voltage is applied to the other electrode in accordance with the drive waveforms shown in FIG. 17 whereby a potential difference corresponding to the sustain pulse Vs shown in FIG. 16 is generated between the sustain discharge electrodes (X- and Y-electrodes). With this arrangement, the breakdown voltage of each element of the driving device can be made lower as compared to a case wherein a surface-discharge PDP is driven in accordance with the drive waveforms shown in FIG. 16.

However, when voltages are applied to the X- and Y-electrodes in accordance with the drive waveforms shown in FIG. 17, wall charges remain on the address electrode A after the end of the sustain discharge period, as shown in FIG. 18.

FIG. 18 is a view showing wall charges formed on the respective electrodes (address electrode, X-electrodes Xi, and Y-electrodes Yi) after the end of the sustain discharge period. FIG. 18 shows wall charges formed on the respective electrodes when the sustain pulse voltage Vs/2 is last applied to the X-electrodes Xi and the sustain pulse voltage (−Vs/2) is last applied to the Y-electrodes Yi in the sustain discharge period.

As shown in FIG. 18, at the end of the sustain discharge period, negative wall charges are formed on the X-electrodes Xi (X1, X2, and X3 in FIG. 18) to which the voltage Vs/2 is applied, and positive wall charges are formed on the Y-electrodes Yi (Y1 and Y2 in FIG. 18) to which the voltage (−Vs/2) is applied. In addition, positive wall charges are formed at portions of the address electrode at the GND potential, which correspond to the X-electrodes Xi, and negative wall charges are formed at portions of the address electrode, which correspond to the Y-electrodes Yi.

If wall charges are formed on the address electrode after the end of the sustain discharge period, charges with opposite polarities are formed on address electrodes, X-electrodes, and Y-electrodes of neighboring cells in addressing (selecting cells to be turned on) in the next subfield. In addressing in the second next subfield, even when the address pulse Va is applied to the address electrode in accordance with display data, the potential difference between the address electrode and the Y-electrode may not reach the discharge voltage due to the residual charges, and address discharge between the address electrode and the Y-electrode may not occur. For example, if cells are repeatedly turned on/off in the respective subfields, as shown in FIG. 19, cells 31 and 32 which are supposed to be turned on in the subfield SF2 may not be turned on.

Conversely, if wall charges remain on the address electrode after the end of the sustain discharge period, the potential difference between the address electrode and the Y-electrode may reach the discharge voltage even when the address pulse Va is not applied to the address electrode, and address discharge may occur between the address electrode and the Y-electrode for a cell that is supposed to be kept off.

That is, when wall charges remain on the address electrode after the end of the sustain discharge period, in selecting (addressing) a cell to be turned on in the address period, the cell to be turned on cannot be accurately selected in accordance with display data. This degrades the drive margin or display quality of the PDP.

SUMMARY OF THE INVENTION

The present invention has been made to solve the above problem, and has as its object to accurately select a cell to be turned on in accordance with display data and suppress any degradation in drive margin or display quality of a plasma display device.

A method of driving a plasma display device according to the present invention is characterized by the removal step of removing wall charges formed, by sustain discharge between sustain discharge electrodes, on an address electrode for selecting a display cell formed between the sustain discharge electrodes.

Since the present invention comprises the above technique, when the wall charges formed by sustain discharge between the sustain discharge electrodes are removed, a cell to be turned on in accordance with display data can be accurately selected without any influence of the wall charges remaining due to sustain discharge.

DETAILED DESCRIPTION OF THE PREFERRED EMBODIMENTS

The embodiments of the present invention will be described below with reference to the accompanying drawings.

Figure 10:
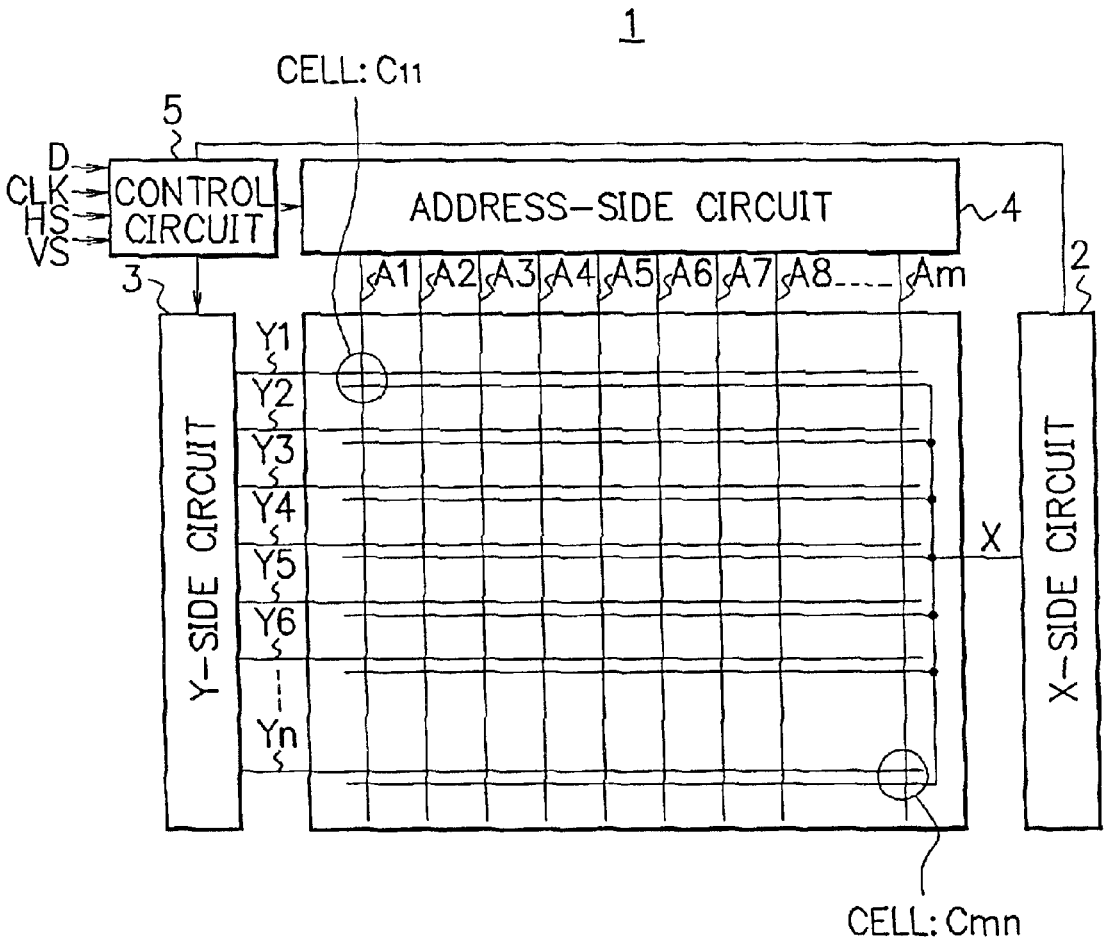
FIG. 10 is a view showing the overall arrangement of an AC-driven PDP device.
Figure 11A:
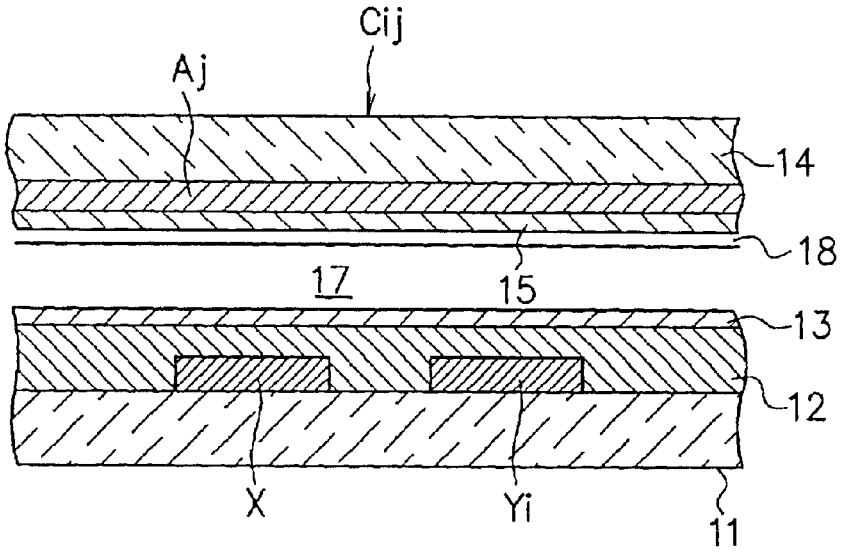
FIG. 11A is a sectional view showing the sectional structure of a cell Cij as a pixel, which is in the ith row and jth column.
Figure 11B:
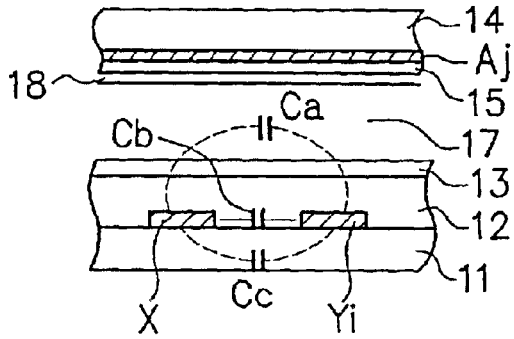
FIG. 11B is a view for explaining the capacitance of a cell that performs sustain discharge in the AC-driven PDP.
Figure 11C:
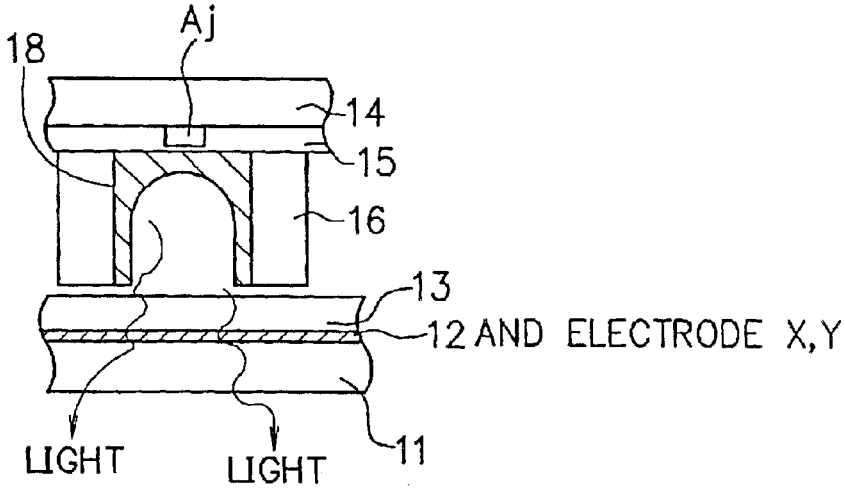
FIG. 11C is a view for explaining light emission of the AC-driven PDP.
Figure 12:
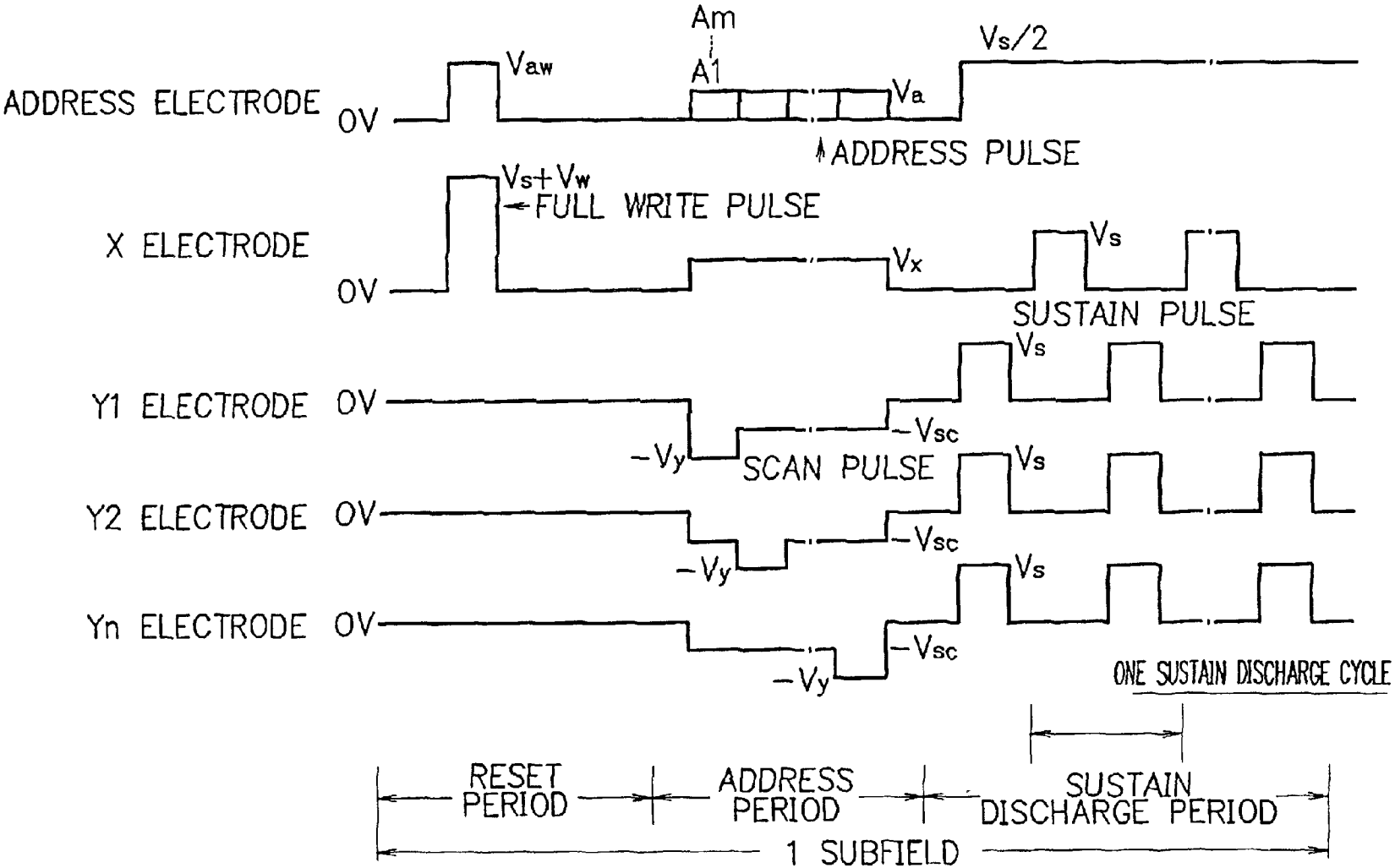
FIG. 12 PRIOR ART
FIG. 12 is a timing chart showing a conventional method of driving an AC-driven PDP.
Figure 13:
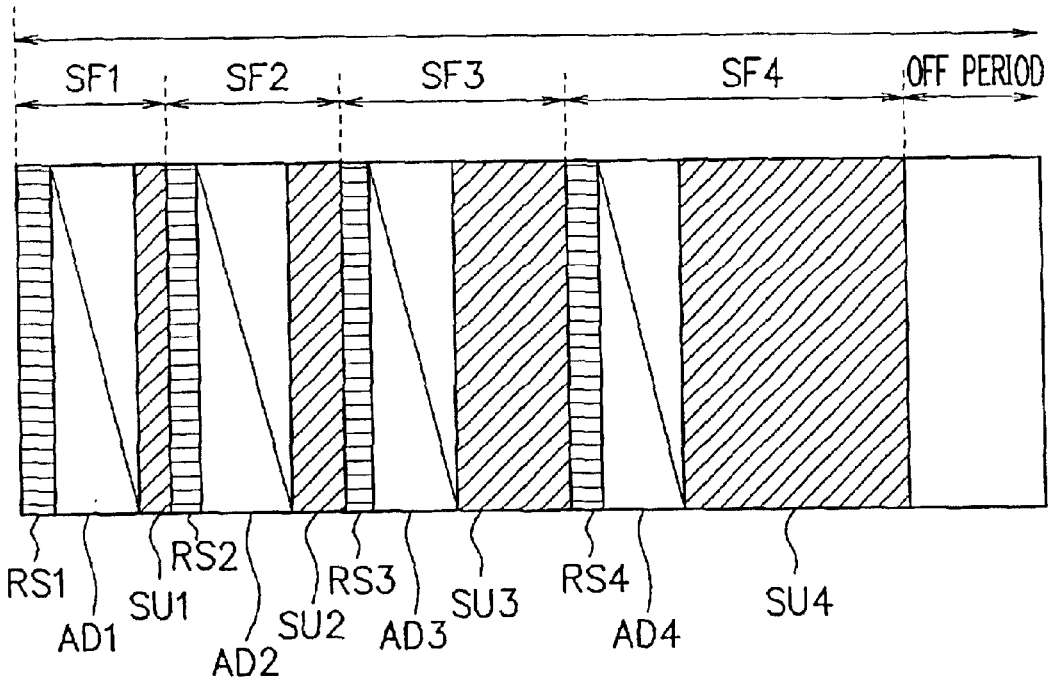
FIG. 13 is a view showing the structure of one frame.
Figure 14A:
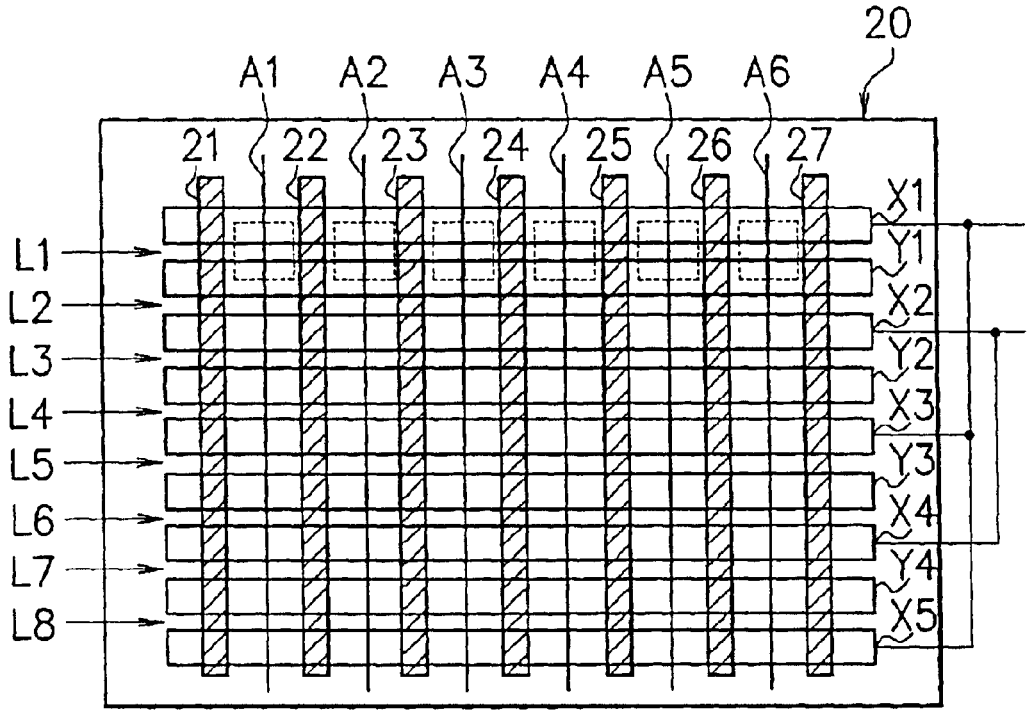
FIG. 14A is a schematic view showing the arrangement of a surface-discharge PDP.
Figure 14B:
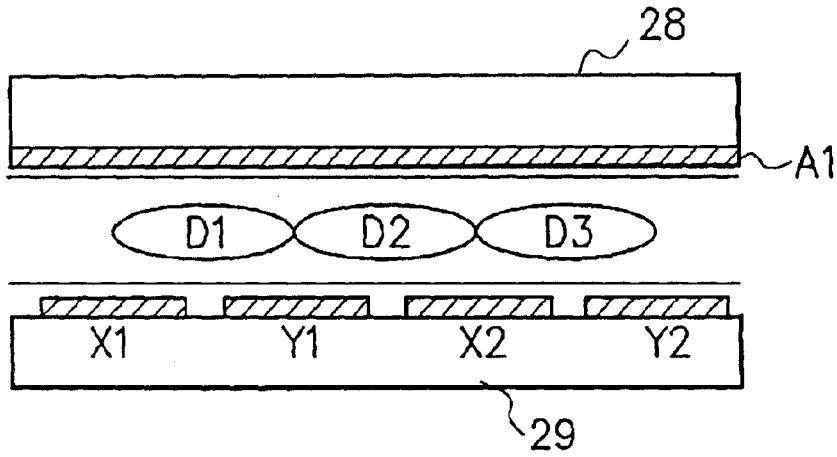
FIG. 14B is a sectional view of the surface-discharge PDP.
Figure 15:
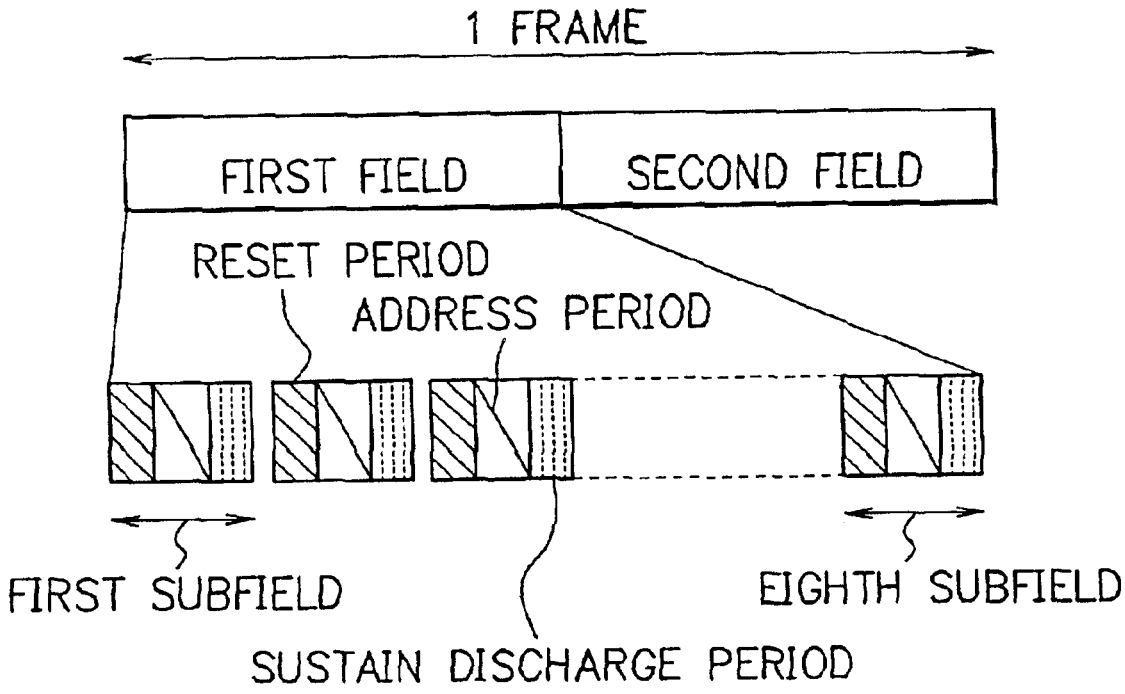
FIG. 15 is a view showing the structure of a frame of the surface-discharge PDP.
Figure 16:
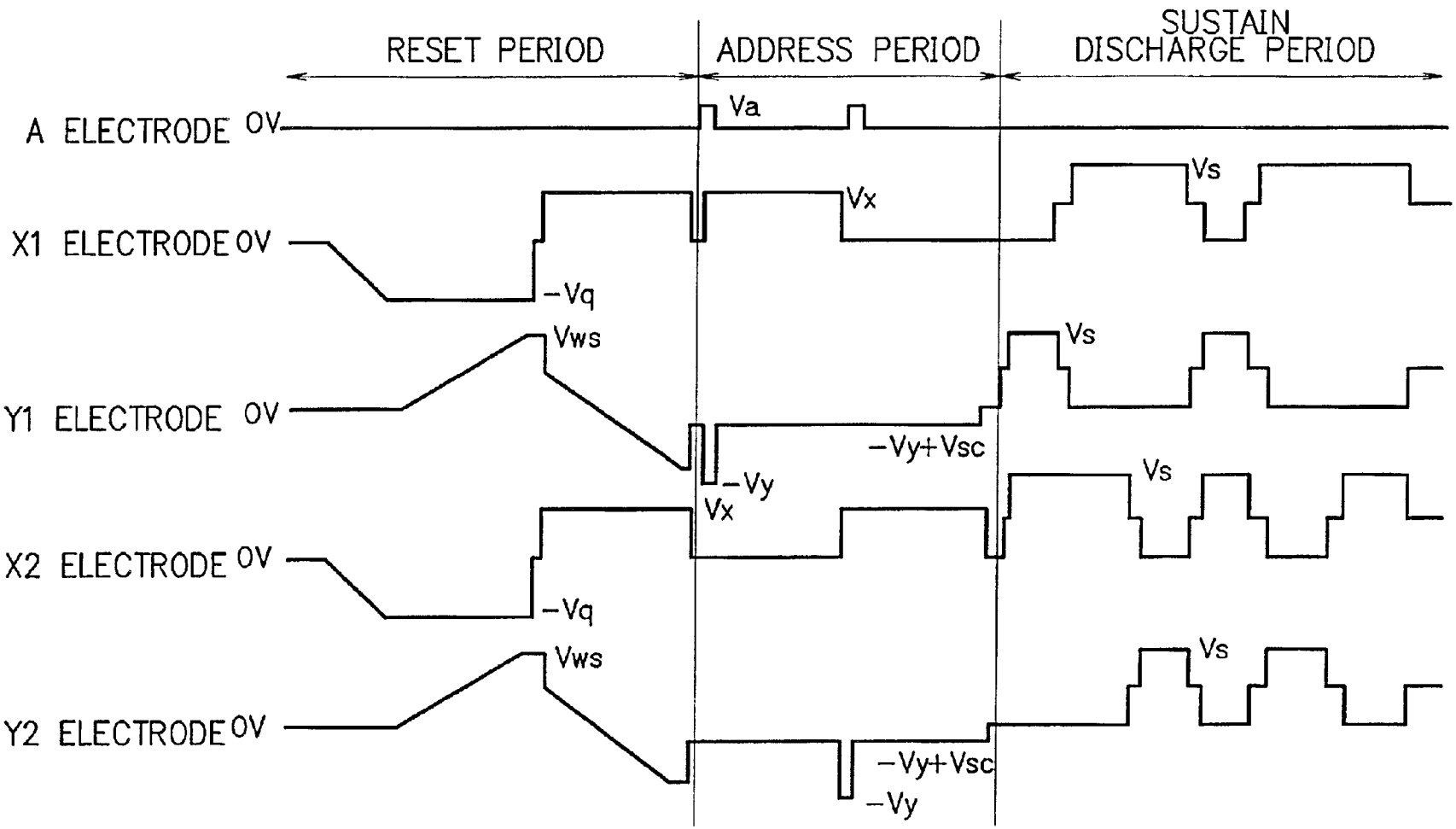
FIG. 16 is a timing chart showing an example of the drive waveforms of the surface-discharge PDP.
Figure 17:
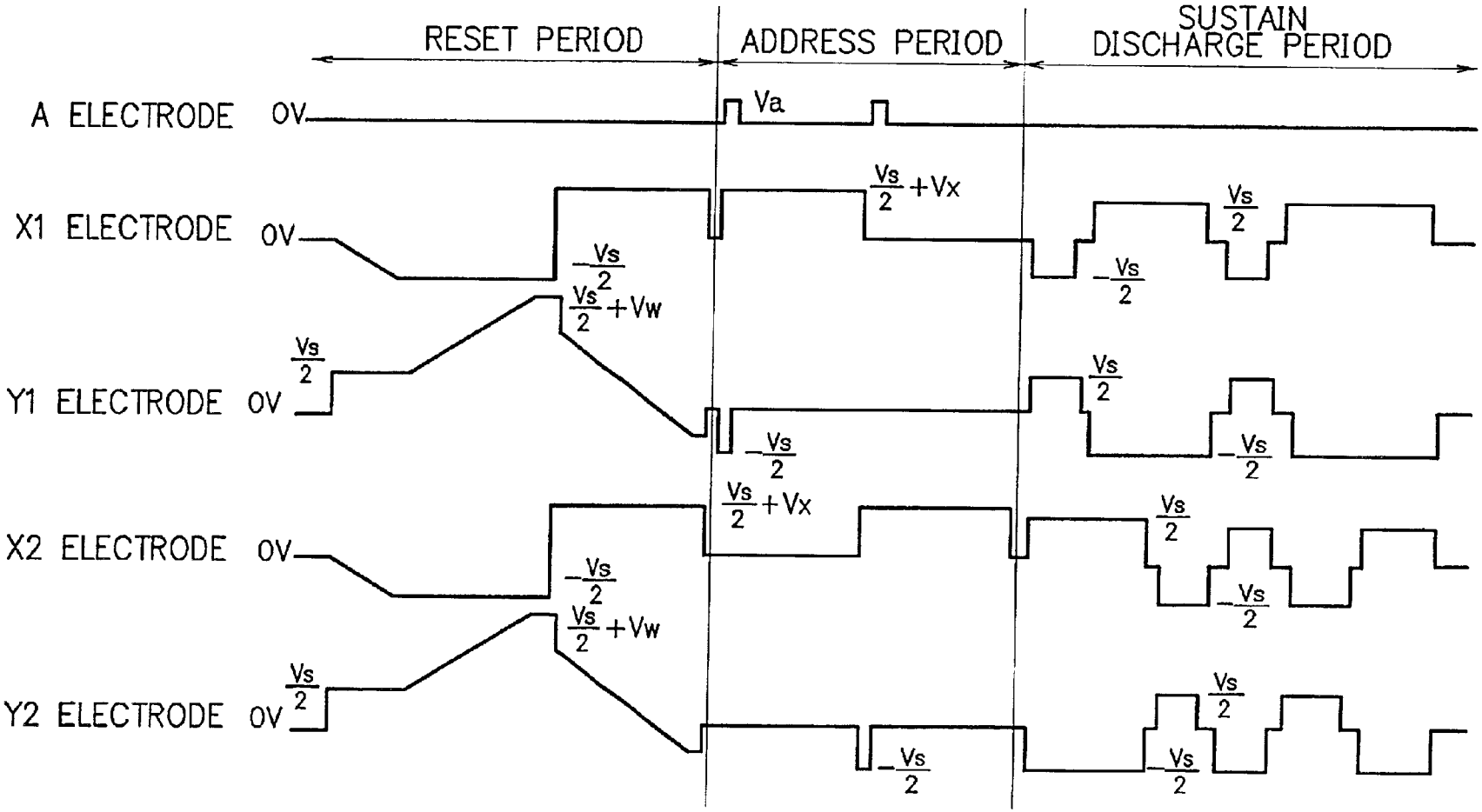
FIG. 17 is a timing chart showing another example of the drive waveforms of the surface-discharge PDP.
Figure 18:
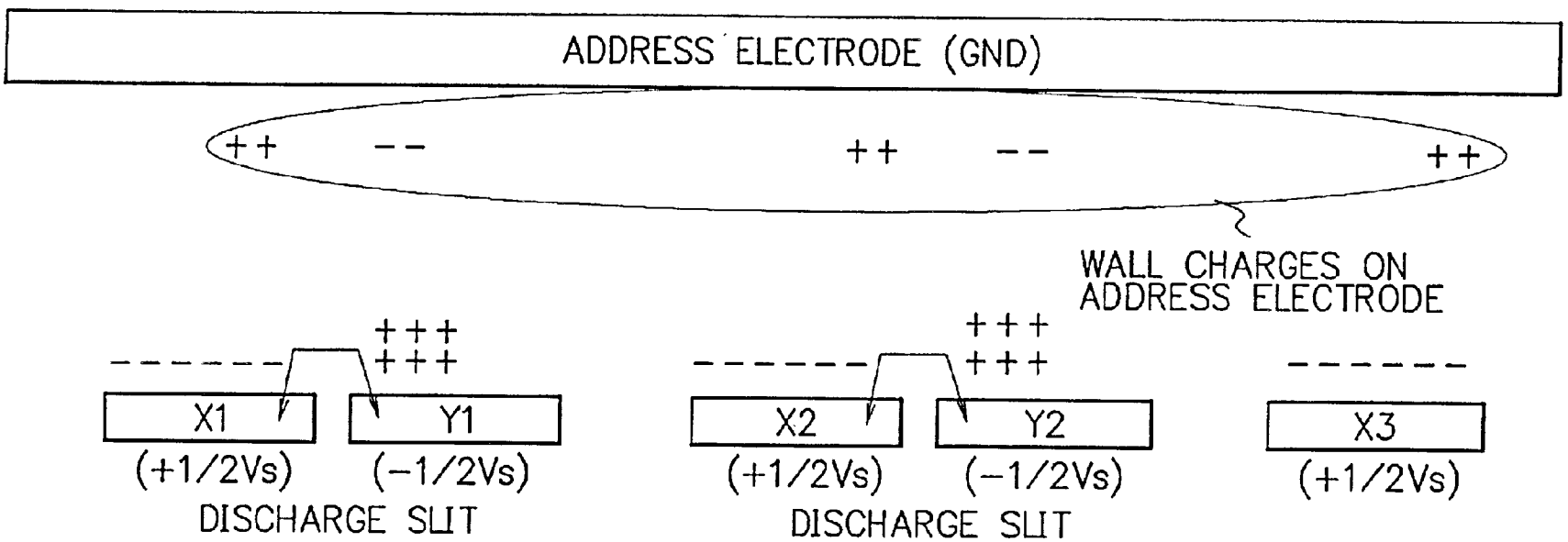
FIG. 18 is a view showing wall charges formed on the respective electrodes after the end of a sustain discharge period.
Figure 19:
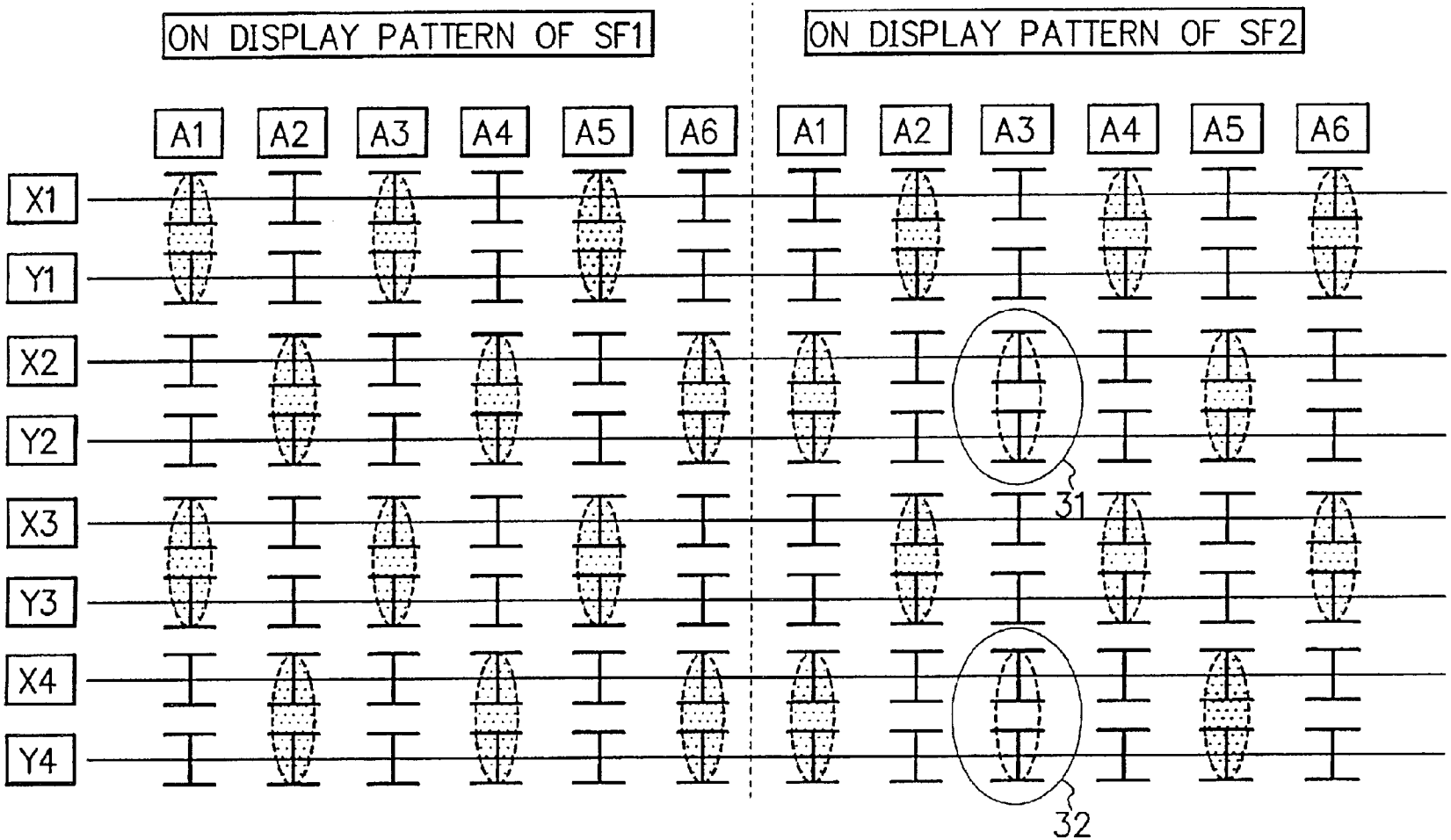
FIG. 19 is a view showing a display example in which cells are repeatedly turned on/off in the respective subfields.

The embodiments to be described below can be applied to, e.g., an AC-driven PDP device as shown in FIG. 10 which has a surface-discharge PDP shown in FIG. 14.

Timing charts that show examples of the drive waveforms of AC-driven PDPs according to the embodiments to be described below show the drive waveforms of an arbitrary address electrode A, X-electrodes X1 and X2, and Y-electrodes Y1 and Y2. For the remaining X- and Y-electrodes, each set of two X-electrodes and two Y-electrodes (X-electrode X3, Y-electrode Y3, X-electrode X4, and Y-electrode Y4), (X-electrode X5, Y-electrode Y5, X-electrode X6, and Y-electrode Y6), . . . is driven by the same drive waveforms as those of the X-electrodes X1 and X2 and Y-electrodes Y1 and Y2.

(First Embodiment)

Figure 1:
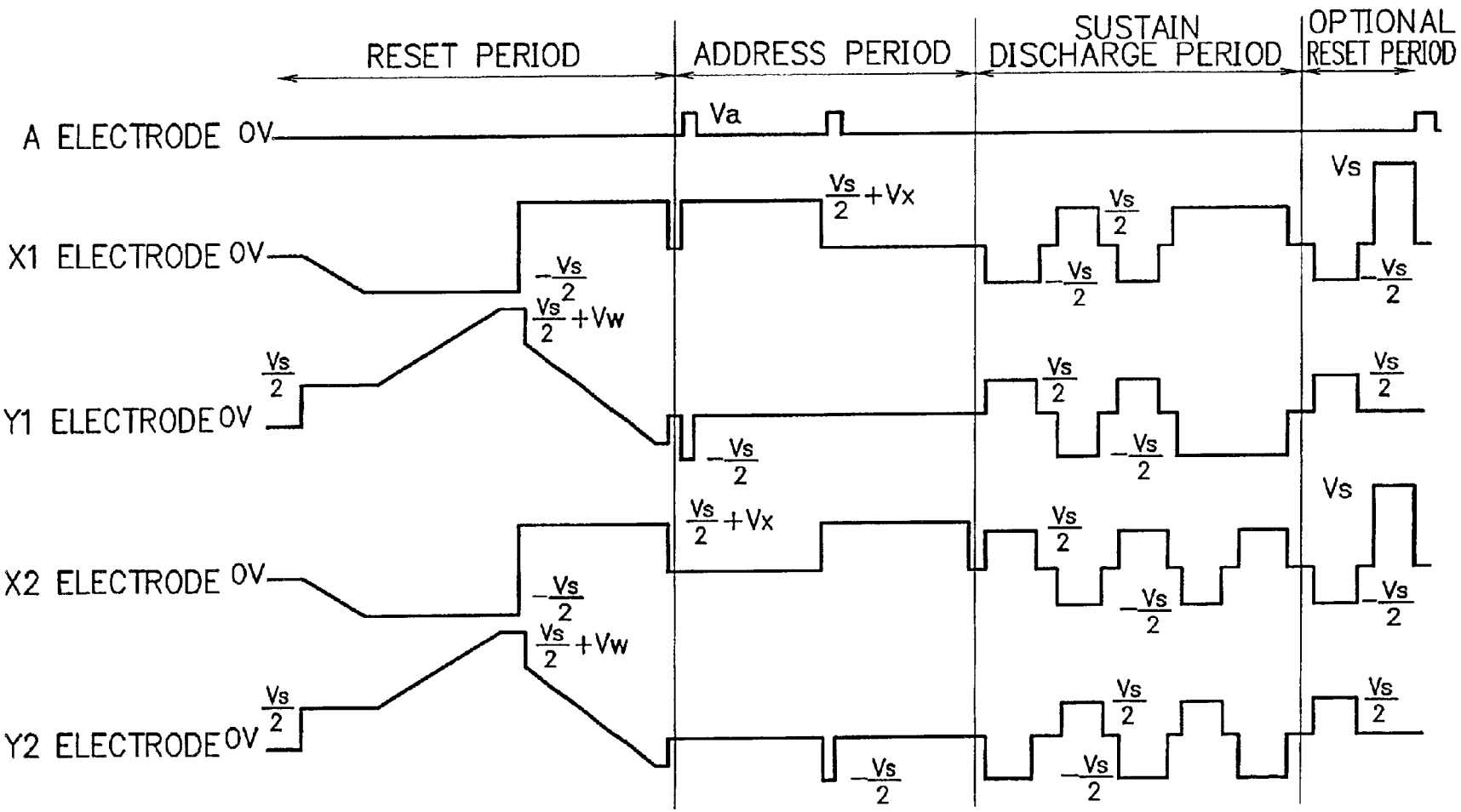
FIG. 1 is a timing chart showing an example of the drive waveforms of an AC-driven PDP according to the first embodiment.

FIG. 1 is a timing chart showing an example of the drive waveforms of an AC-driven PDP according to the first embodiment.

FIG. 1 shows drive waveforms in the first field where discharge is performed between an X-electrode Xi and a Y-electrode Yi (i is an arbitrary integer) to display an image and, more specifically, drive waveforms in one of a plurality of subfields of the first field. One subfield is divided into a reset period comprised of a full write period and full erase period, an address period, a sustain discharge period, and an optional reset period.

In the reset period, first, a voltage (−Vs/2) is applied to the X-electrodes X1 and X2. A voltage Vs/2 is applied to the Y-electrodes Y1 and Y2, and then a ramp wave with a voltage (Vs/2+Vw) is applied to the Y-electrodes Y1 and Y2. With this operation, discharge occurs in all cells of all display lines to form wall charges independently of the preceding display state (full write). When such a ramp wave is applied, discharge sequentially occurs in cells that have reached the discharge voltage during the rise of the ramp wave. Actually, an optimum voltage (voltage almost equal to the discharge start voltage) is applied to each cell.

Next, a voltage (Vs/2+Vx) is applied to the X-electrodes X1 and X2 and a ramp wave whose final voltage is a negative voltage is applied to the Y-electrodes Y1 and Y2. As the voltage of wall charges themselves exceeds the discharge start voltage in all cells, discharge starts (full erase). At this time as well, weak discharge occurs in accordance with application of the ramp wave, so the accumulated wall charges are erased with some exceptions.

In the address period, address discharge is line-sequentially performed to turn on/off each cell in accordance with display data. The address period is divided into the first half portion and second half portion. At the first half portion in the address period, address discharge is performed for odd-numbered Y-electrodes. At the second half portion of the address period, address discharge is performed for even-numbered Y-electrodes. At the first half portion in the address period, the voltage (Vs/2+Vx) is applied to odd-numbered X-electrodes which should perform discharge with odd-numbered Y-electrodes in the sustain discharge period. At the second half portion in the address period, the voltage (Vs/2+Vx) is applied to even-numbered X-electrodes which should perform discharge with even-numbered Y-electrodes in the sustain discharge period.

In this address period, the voltage (−Vs/2) is applied to the Y-electrode selected for address discharge, and the remaining Y-electrodes are set at ground level (0 V). At the same time, an address pulse having a voltage Va is selectively applied to the address electrode A corresponding to a cell which should cause sustain discharge, i.e., a cell to be turned on. As a result, discharge occurs between the Y-electrode and the address electrode A of the cell to be turned on. With this priming (pilot flame), discharge between the Y-electrode and the X-electrode having the voltage (Vs/2+Vx) starts, and wall charges in an amount enough for sustain discharge are accumulated.

FIG. 1 shows only address discharge for the Y-electrodes Y1 and Y2. At the first half portion in the address period, the Y-electrodes Y1, Y3, Y5 . . . are sequentially selected in this order for address discharge. At the second half portion in the address period, the Y-electrodes Y2, Y4, Y6, . . . are sequentially selected in this order for address discharge.

In the subsequent sustain discharge period, the positive voltage Vs/2 and negative voltage (−Vs/2) are alternately applied to the sustain discharge electrodes (X- and Y-electrodes). The voltages applied to the X- and Y-electrodes have opposite polarities. That is, when the positive voltage Vs/2 is applied to the X-electrodes, the negative voltage (−Vs/2) is applied to the Y-electrodes. With this operation, the potential difference between the X-electrode and the Y-electrode corresponds to a sustain pulse voltage Vs for discharge between the X-electrode and the Y-electrode, so sustain discharge occurs between the sustain discharge electrodes (X- and Y-electrodes).

In the optional reset period, first, the voltage (−Vs/2) is applied to the X-electrodes X1 and X2, and the voltage Vs/2 is applied to the Y-electrodes Y1 and Y2. Next, all the X-electrodes X1 and X2 and Y-electrodes Y1 and Y2 are set at the ground level, and then, the voltage Vs twice the sustain pulse voltage is applied to the X-electrodes X1 and X2. With this operation, discharge occurs between the X-electrodes X1 and X2 and the Y-electrodes Y1 and Y2. During this time, the address electrode A is kept at the ground level.

After that, the X-electrodes X1 and X2 are set at the ground level (0 V), and a pulse having the voltage Va is applied to the address electrode A. With this operation, self-erase discharge is performed between the address electrode A and the X-electrodes X1 and X2. At this time, the Y-electrodes Y1 and Y2 are at the ground level.

Figure 2A:
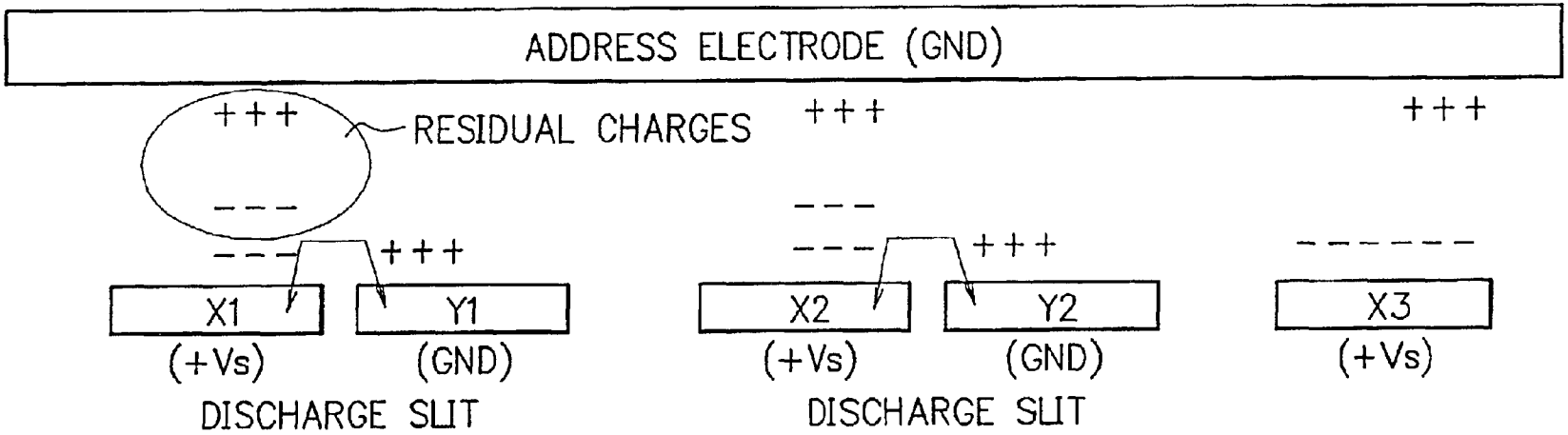
FIGS. 2A and 2B are views for explaining wall charges formed on the respective electrodes in an optional reset period.
Figure 2B:
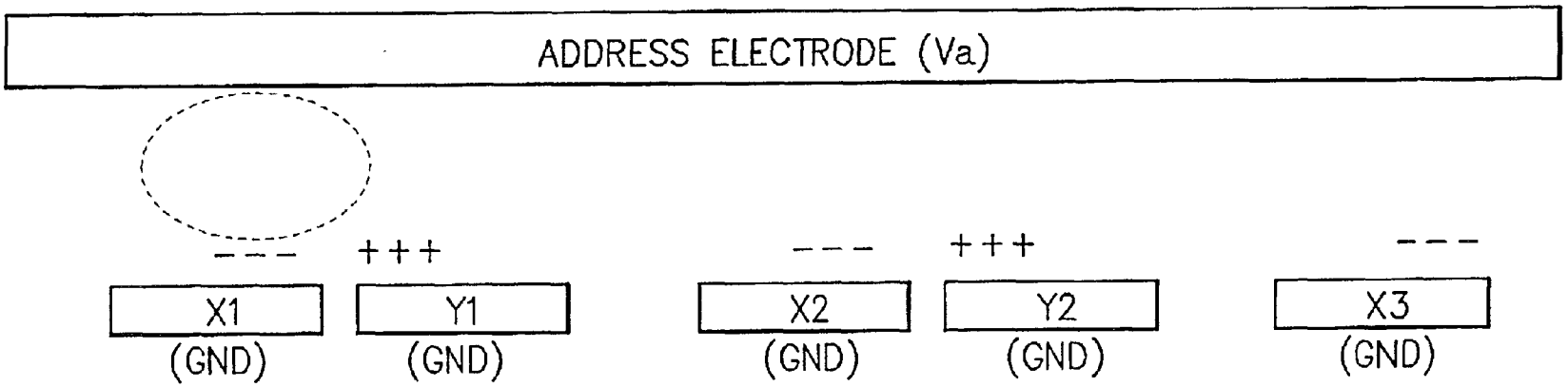

FIGS. 2A and 2B are views for explaining wall charges formed on the respective electrodes (address electrode, X-electrodes, and Y-electrodes) in the optional reset period shown in FIG. 1.

FIG. 2A shows wall charges formed on the respective electrodes (address electrode, X-electrodes, and Y-electrodes) when the voltage Vs twice the sustain pulse voltage is applied to the X-electrodes in the optional reset period. As shown in FIG. 2A, when the voltage Vs twice the sustain pulse voltage is applied to the X-electrodes X1, X2, and X3, discharge occurs between the X-electrode Xi and the Y-electrode Yi (i is an arbitrary integer) at ground level (0 V). Negative wall charges are formed on the X-electrodes X1, X2, and X3, and positive wall charges are formed on the Y-electrodes Y1 and Y2. The address electrode at the ground level (0 V) serves as a cathode with respect to the X-electrodes X1, X2, and X3. Hence, positive wall charges are formed at portions of the address electrode, which correspond to the X-electrodes X1, X2, and X3.

FIG. 2B is a view showing wall charges formed on the respective electrodes when the pulse with the voltage Va is applied to the address electrode in the state shown in FIG. 2A wherein the wall charges are being formed on the respective electrodes. When the pulse with the voltage Va is applied to the address electrode, self-erase discharge occurs between the address electrode and the X-electrodes X1, X2, and X3. That is, the wall charges on the address electrode and X-electrodes X1, X2, and X3 are neutralized, and the residual wall charges are removed. As a consequence, as shown in FIG. 2B, some of the negative wall charges remain on the X-electrodes X1, X2, and X3, and the positive wall charges on the address electrode are removed.

Figure 3:
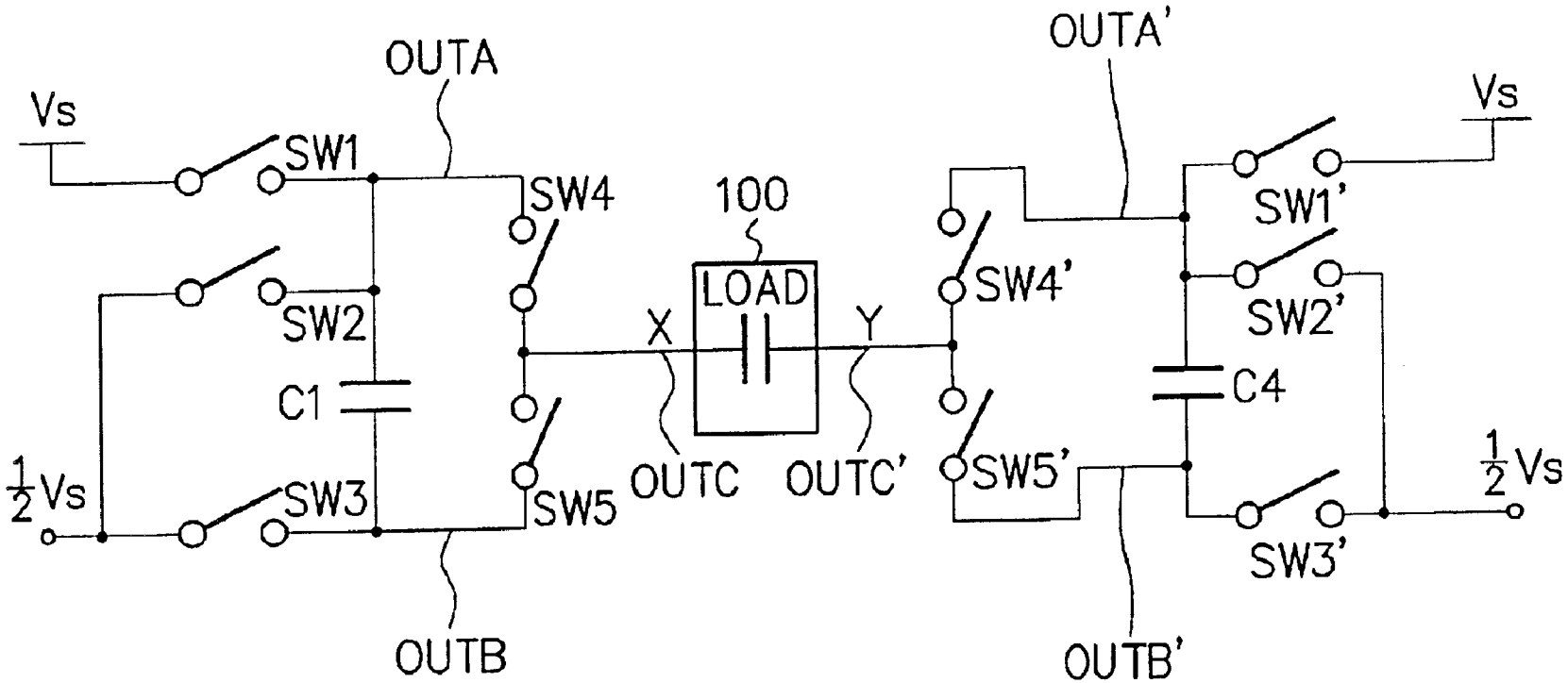
FIG. 3 is a circuit diagram showing the arrangement of a Vs generation circuit.

FIG. 3 is a circuit diagram showing the arrangement of a Vs generation circuit for applying the voltage Vs twice the sustain pulse voltage to the X-electrodes X1 and X2 in the optional reset period of the drive waveforms shown in FIG. 1.

Referring to FIG. 3, a load 100 is a total capacitance Cpcell of a cell between sustain discharge electrodes, which is formed between one X-electrode and one Y-electrode. An X-electrode and Y-electrode are formed on the load 100.

On the X-electrode side, switches SW1 and SW2 are connected in series between a power supply line of the voltage Vs supplied from a power supply (not shown) and a power supply line of the voltage Vs/2. One terminal of a capacitor Cl is connected to the interconnection node between the two switches SW1 and SW2. A switch SW3 is connected between the other terminal of the capacitor C1 and the power supply line of the voltage Vs/2.

Switches SW4 and SW5 are connected in series between the two terminals of the capacitor C1. The switch SW4 is connected to one terminal of the capacitor C1 through a first signal line OUTA, and the switch SW5 is connected to the other terminal of the capacitor C1 through a second signal line OUTB. The X-electrode of the load 100 is connected to the interconnection node between the two switches SW4 and SW5 through an output line OUTC.

The arrangement on the Y-electrode side is the same as that on the X-electrode side, and a description thereof will be omitted.

Figure 4:
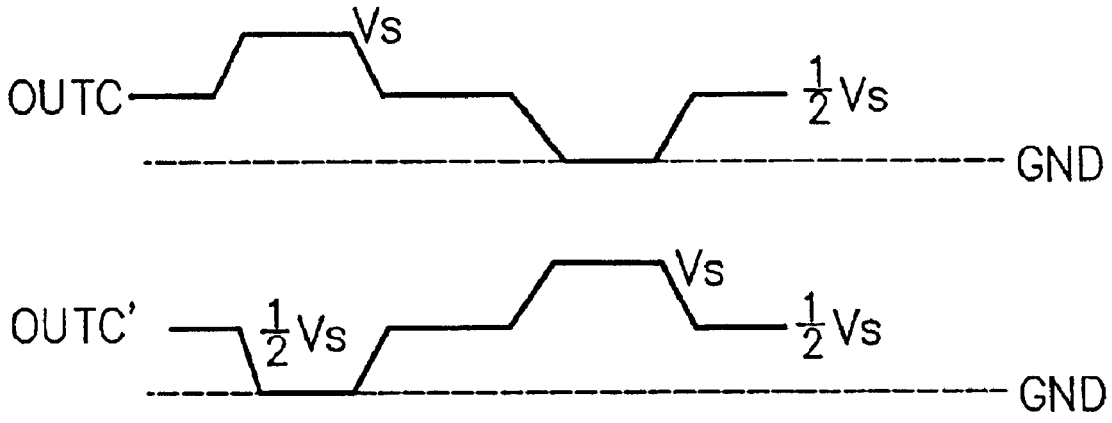
FIG. 4 is a timing chart of the Vs generation circuit.

FIG. 4 is a timing chart of the Vs generation circuit shown in FIG. 3.

Referring to FIG. 4, first, when the two switches SW1 and SW3 on the X-electrode side are turned on, and the remaining switches SW2, SW4, and SW5 are turned off, the voltage of the first signal line OUTA changes to the voltage level Vs supplied from the power supply (not shown) through the switch SW1. At this time, charges corresponding to the potential difference (Vs/2) between the switches SW1 and SW3 connected to the power supplies (neither are shown) are accumulated in the capacitor C1 connected between the switches SW1 and SW3. After that, the switch SW4 is turned on, and switches SW4' and SW2' on the Y-electrode side are turned on. The voltage Vs of the first signal line OUTA is applied to the X-electrode of the load 100 through the output line OUTC, so the voltage Vs is applied between the X-electrode and the Y-electrode.

Next, when the switch SW4 is turned off to disconnect the current path for voltage application, and then, the switch SW5 is turned on like a pulse, the voltage of the output line OUTC changes to the voltage level (Vs/2) supplied from the power supply (not shown) through the switch SW3 and a second signal line OUTB'. The switch SW2 is turned on, and the remaining four switches SW1, SW3, SW4, and SW5 are turned off. After that, the switch SW4 is turned on like a pulse. When the switch SW4 is turned on, the current path to the X-electrode in applying a voltage to the Y-electrode side is formed.

The switch SW5 is turned on while keeping the switch SW2 ON. At this time, since no power supply voltage is supplied from the power supply (not shown) to the first signal line OUTA through the switch SW1, the voltage of the first signal line OUTA is Vs/2. On the other hand, the second signal line OUTB is set at the ground level (0 V) that is lower than the (Vs/2) corresponding to the charges accumulated in the capacitor C1 by Vs/2 because the switch SW2 is turned on to ground the first signal line OUTA.

Since the switch SW5 is ON, the X-electrode-side potential of the load 100 connected to the second signal line OUTB through the output line OUTC is at the ground level. At this time, switches SW3' and SW4' on the scanning electrode Y side are ON.

Next, the switches SW2 and SW4 are turned on, and the remaining switches SW1, SW3, and SW5 are turned off. The voltage of the output line OUTC changes to Vs/2.

Figure 5:
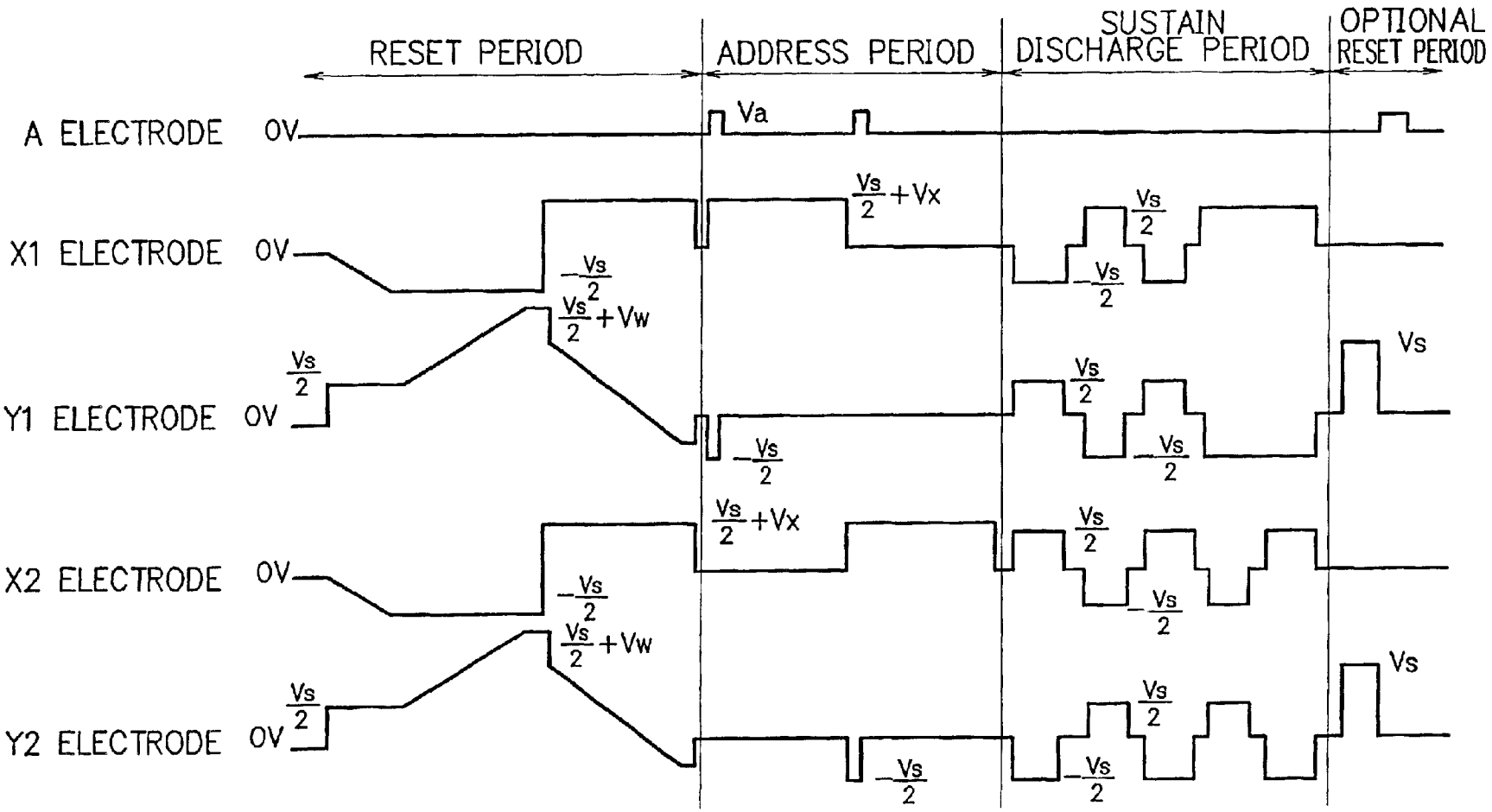
FIG. 5 is a timing chart showing another example of the drive waveforms of the AC-driven PDP according to the first embodiment.

FIG. 5 is a timing chart showing another example of the drive waveforms of the AC-driven PDP according to the first embodiment. In the timing chart of the drive waveforms shown in FIG. 5, the X-electrodes X1 and X2 are set at ground level, and the voltage Vs twice the sustain pulse voltage is applied to the Y-electrodes Y1 and Y2 in the optional reset period, unlike the timing chart of the drive waveforms shown in FIG. 1 in which the voltage Vs twice the sustain pulse voltage is applied to the X-electrodes X1 and X2 in the optional reset period.

FIG. 5 shows drive waveforms in the first field and, more specifically, drive waveforms in one of a plurality of subfields of the first field, as in FIG. 1. One subfield is divided into a reset period comprised of a full write period and full erase period, an address period, a sustain discharge period, and an optional reset period.

The drive waveforms in the reset period, address period, and sustain discharge period in FIG. 5 are the same as those shown in FIG. 1, and a repetitive description will be omitted.

In the optional reset period, first, all the X-electrodes X1 and X2 and Y-electrodes Y1 and Y2 are set at ground level. Then, the voltage Vs twice the sustain pulse voltage is applied to the Y-electrodes Y1 and Y2. With this operation, discharge occurs between the X-electrodes X1 and X2 and the Y-electrodes Y1 and Y2. During this time, the address electrode A is kept at the ground level.

Next, the Y-electrodes Y1 and Y2 are set at the ground level (0 V), and a pulse having the voltage Va is applied to the address electrode A. With this operation, self-erase discharge is performed between the address electrode A and the Y-electrodes Y1 and Y2. At this time, the X-electrodes X1 and X2 are at the ground level.

Figure 6A:
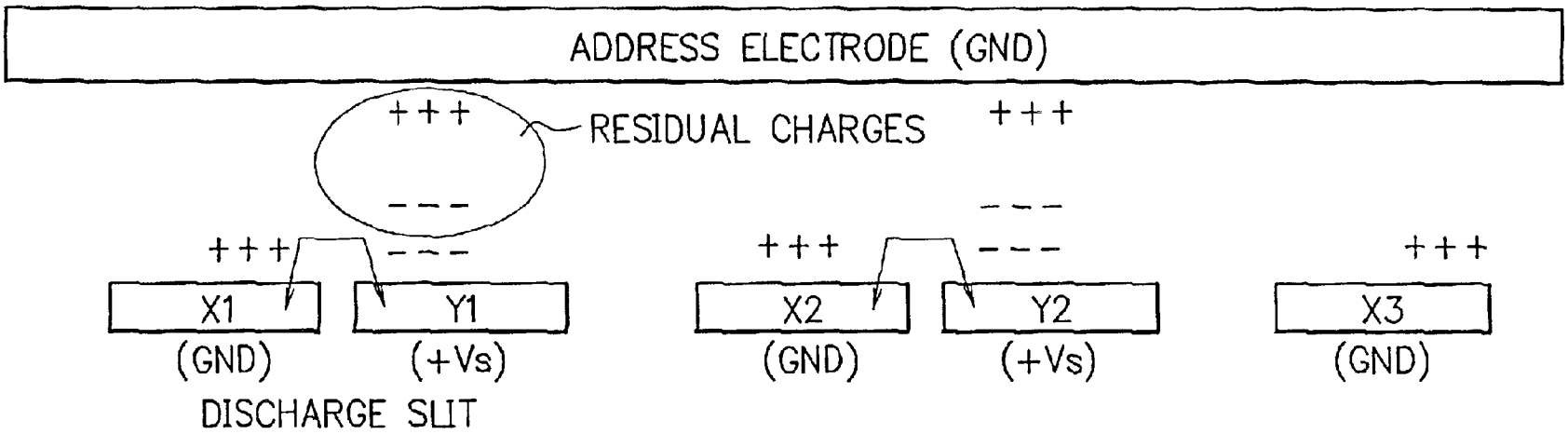
FIGS. 6A and 6B are views for explaining wall charges formed on the respective electrodes in the optional reset period.
Figure 6B:
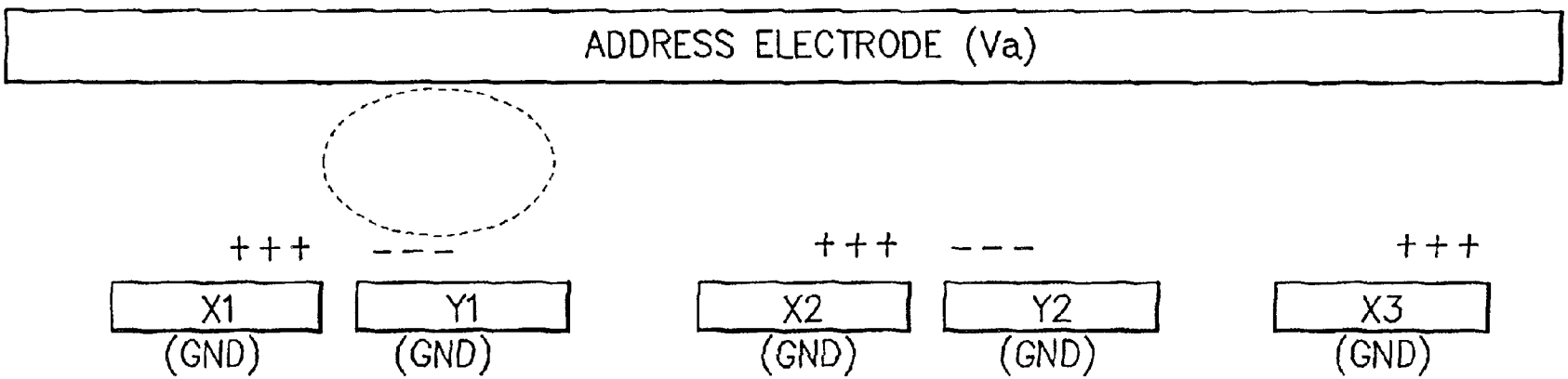

FIGS. 6A and 6B are views for explaining wall charges formed on the respective electrodes (address electrode, X-electrodes, and Y-electrodes) in the optional reset period shown in FIG. 5.

FIG. 6A shows wall charges formed on the respective electrodes when the voltage Vs twice the sustain pulse voltage is applied to the Y-electrodes in the optional reset period. As shown in FIG. 6A, when the voltage Vs twice the sustain pulse voltage is applied to the Y-electrodes Y1 and Y2, discharge occurs between the X-electrode Xi at the ground level (0 V) and the Y-electrode Yi (i is an arbitrary integer). Positive wall charges are formed on the X-electrodes X1, X2, and X3, and negative wall charges are formed on the Y-electrodes Y1 and Y2. The address electrode at the ground level (0 V) serves as a cathode with respect to the Y-electrodes Y1 and Y2. Hence, positive wall charges are formed at portions of the address electrode, which correspond to the Y-electrodes Y1 and Y2.

FIG. 6B is a view showing wall charges formed on the respective electrodes when the pulse with the voltage Va is applied to the address electrode in the state shown in FIG. 6A wherein the wall charges are being formed on the respective electrodes. When the pulse with the voltage Va is applied to the address electrode, self-erase discharge occurs between the address electrode and the Y-electrodes Y1 and Y2. That is, the wall charges on the address electrode and Y-electrodes Y1 and Y2 are neutralized, and the residual wall charges are removed. As a consequence, as shown in FIG. 6B, some of the negative wall charges remain on the Y-electrodes Y1 and Y2, and the positive wall charges on the address electrode are removed.

As described above in detail, according to the first embodiment, after the sustain discharge period of each subfield, discharge is performed between the sustain discharge electrodes by applying the voltage Vs twice the sustain pulse to one of the sustain discharge electrodes whereby wall charges capable of self-erase discharge between the address electrode and one of the sustain discharge electrodes by the pulse with the voltage Va are formed on the address electrode. After that, the pulse with the voltage Va is applied to the address electrode A to cause self-erase discharge between the address electrode and one of the sustain discharge electrodes, thereby removing the wall charges formed on the address electrode.

With this arrangement, in the state wherein wall charges formed on the address electrode upon sustain discharge in the sustain discharge period are removed, a cell to be turned on in accordance with display data can be accurately selected in the address period, and any degradation in drive margin or display quality of the plasma display device can be suppressed.

(Second Embodiment)

The second embodiment of the present invention will be described next.

Figure 7:
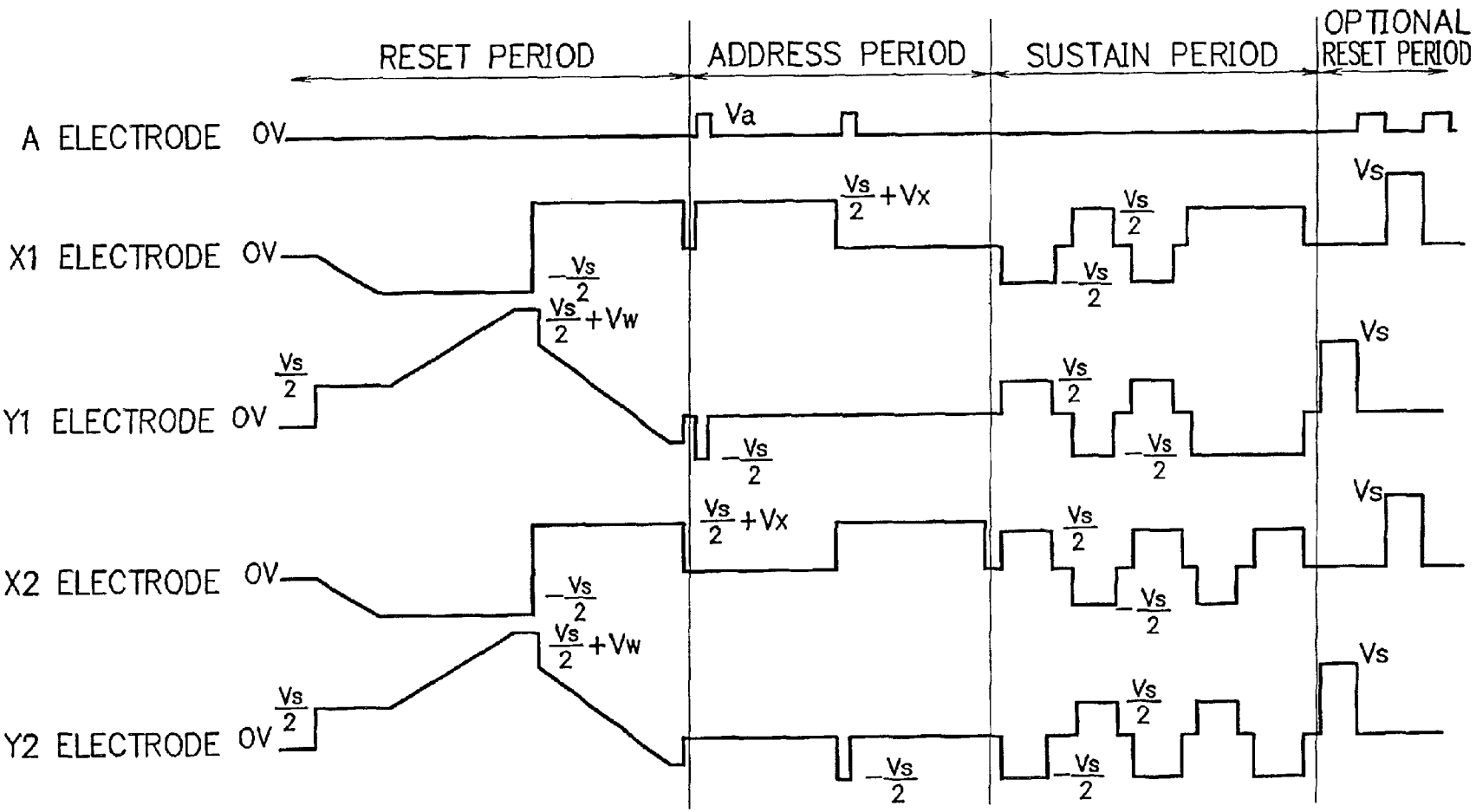
FIG. 7 is a timing chart showing an example of the drive waveforms of an AC-driven PDP according to the second embodiment.

FIG. 7 is a timing chart showing an example of the drive waveforms of an AC-driven PDP according to the second embodiment. In the timing chart of the drive waveforms of the second embodiment, a voltage Vs twice the sustain pulse voltage is applied to both X-electrodes and Y-electrodes at different timings in the optional reset period, unlike the first embodiment in which the voltage Vs twice the sustain pulse voltage is applied to the X-electrode or Y-electrode.

FIG. 7 shows drive waveforms in the first field and, more specifically, drive waveforms in one of a plurality of subfields of the first field. One subfield is divided into a reset period comprised of a full write period and full erase period, an address period, a sustain discharge period, and an optional reset period.

The drive waveforms in the reset period, address period, and sustain discharge period in FIG. 7 are the same as those shown in FIG. 1, and a repetitive description will be omitted.

In the optional reset period, first, all X-electrodes X1 and X2 and Y-electrodes Y1 and Y2 are set at ground level. Then, the voltage Vs twice the sustain pulse voltage is applied to the Y-electrodes Y1 and Y2. With this operation, discharge occurs between the X-electrodes X1 and X2 and the Y-electrodes Y1 and Y2. During this time, an address electrode A is kept at the ground level.

Next, the Y-electrodes Y1 and Y2 are set at the ground level (0 V), and a pulse having a voltage Va is applied to the address electrode A. With this operation, self-erase discharge is performed between the address electrode A and the Y-electrodes Y1 and Y2. At this time, the X-electrodes X1 and X2 are at the ground level.

After that, the address electrode A is set at the ground level, and the voltage Vs twice the sustain pulse voltage is applied to the X-electrodes X1 and X2. Then, the Y-electrodes Y1 and Y2 are set at the ground level (0 V), and the pulse with the voltage Va is applied to the address electrode A. With this operation, after the discharge between the X-electrodes X1 and X2 and the Y-electrodes Y1 and Y2, self-erase discharge occurs between the address electrode A and the X-electrodes X1 and X2.

Figure 8A:
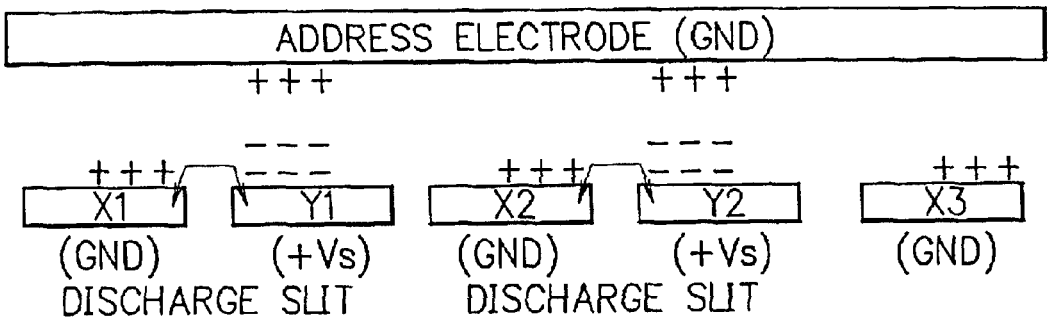
FIGS. 8A to 8C are views for explaining wall charges formed on the respective electrodes (address electrode, X-electrodes, and Y-electrodes) in an optional reset period.
Figure 8B:
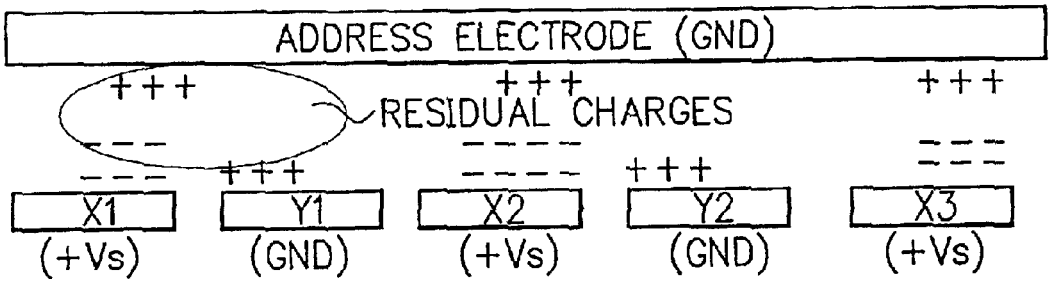

FIGS. 8A and 8B are views for explaining wall charges formed on the respective electrodes (address electrode, X-electrodes, and Y-electrodes) in the optional reset period shown in FIG. 7.

FIG. 8A shows wall charges formed on the respective electrodes when the voltage Vs twice the sustain pulse voltage is applied to the Y-electrodes in the optional reset period. As shown in FIG. 8A, when the voltage Vs twice the sustain pulse voltage is applied to the Y-electrodes Y1 and Y2, discharge occurs between an X-electrode Xi at the ground level (0 V) and a Y-electrode Yi (i is an arbitrary integer). Positive wall charges are formed on the X-electrodes X1, X2, and X3, and negative wall charges are formed on the Y-electrodes Y1 and Y2. The address electrode at the ground level (0 V) serves as a cathode with respect to the Y-electrodes Y1 and Y2. Hence, positive wall charges are formed at portions of the address electrode, which correspond to the Y-electrodes Y1 and Y2.

FIG. 8B is a view showing wall charges formed on the respective electrodes when the pulse with the voltage Va is applied to the address electrode to remove the wall charges formed on the Y-electrodes in the state shown in FIG. 8A wherein the wall charges are being formed on the respective electrodes, and then the voltage Vs twice the sustain pulse voltage is applied to the X-electrodes. As shown in FIG. 8B, when the voltage Vs twice the sustain pulse voltage is applied to the X-electrodes X1, X2, and X3, discharge occurs between the X-electrode Xi and the Y-electrode Yi (i is an arbitrary integer) at ground level (0 V). Negative wall charges are formed on the X-electrodes X1, X2, and X3, and positive wall charges are formed on the Y-electrodes Y1 and Y2. The address electrode at the ground level (0 V) serves as a cathode with respect to the X-electrodes X1, X2, and X3. Hence, positive wall charges are formed at portions of the address electrode, which correspond to the X-electrodes X1, X2, and X3.

Figure 8C:
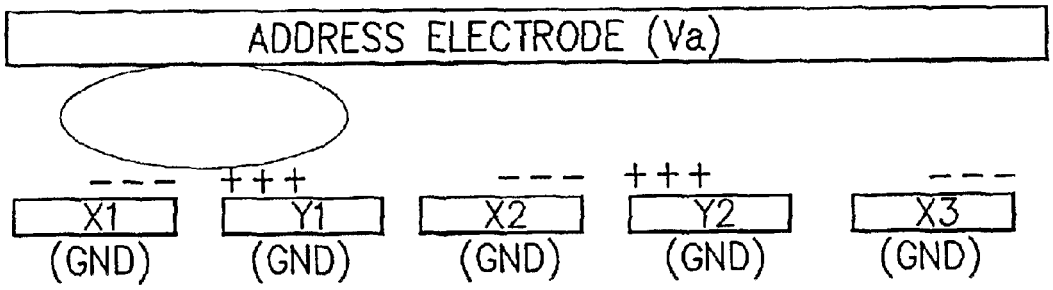

FIG. 8C is a view showing wall charges formed on the respective electrodes when the pulse with the voltage Va is applied to the address electrode in the state shown in FIG. 8B wherein the wall charges are being formed on the respective electrodes. When the pulse with the voltage Va is applied to the address electrode, self-erase discharge occurs between the address electrode and the X-electrodes X1, X2, and X3. That is, the wall charges on the address electrode and X-electrodes X1, X2, and X3 are neutralized, and the residual wall charges are removed. As a consequence, as shown in FIG. 8C, some of the negative wall charges remain on the X-electrodes X1, X2, and X3, and the positive wall charges on the address electrode are removed.

As described above, according to the second embodiment, after the sustain discharge period of each subfield, discharge is performed between the sustain discharge electrodes by applying the voltage Vs twice the sustain pulse to one of the sustain discharge electrodes and then applying the voltage Vs twice the sustain pulse voltage to the other electrode whereby wall charges capable of self-erase discharge between the address electrode and one of the sustain discharge electrodes by the pulse with the voltage Va are formed on the address electrode. After that, the pulse with the voltage Va is applied to the address electrode A to cause self-erase discharge between the address electrode and the other electrode, thereby removing the wall charges formed on the address electrode.

With this arrangement, in the state wherein wall charges formed on the address electrode upon sustain discharge in the sustain discharge period are removed, a cell to be turned on in accordance with display data can be accurately selected in the address period, and any degradation in drive margin or display quality of the plasma display device can be suppressed.

Since the voltage Vs twice the sustain pulse is applied to one of the sustain discharge electrodes and then the voltage Vs twice the sustain pulse voltage is applied to the other electrode, the wall charges formed on the address electrode can be reliably removed independently of the final sustain pulse application state in the sustain discharge period.

In the above-described second embodiment, in the optional reset period, the voltage Vs twice the sustain pulse voltage is applied to the Y-electrodes Y1 and Y2, and then, the voltage Vs is applied to the X-electrodes X1 and X2. However, the voltage Vs twice the sustain pulse voltage may be applied to the X-electrodes X1 and X2, and then, the voltage Vs may be applied to the Y-electrodes Y1 and Y2.

(Third Embodiment)

Figure 9:
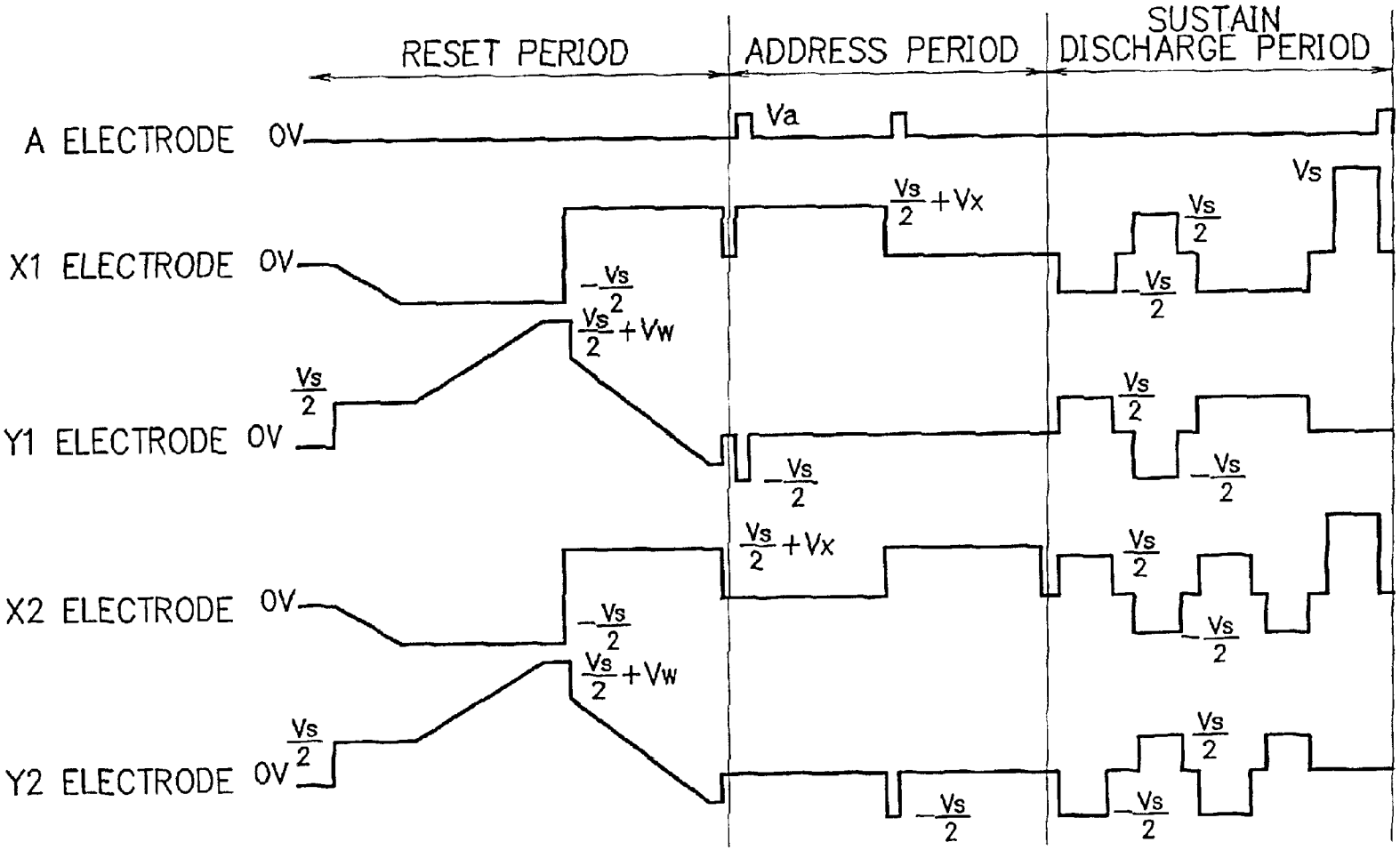
FIG. 9 is a timing chart showing an example of the drive waveforms of an AC-driven PDP according to the third embodiment.

FIG. 9 is a timing chart showing an example of the drive waveforms of the AC-driven PDP according to the third embodiment. In the timing chart of the drive waveforms shown in FIG. 9, the sustain pulse to be applied at the end of the sustain discharge period is replaced with a twice voltage Vs and applied to sustain discharge electrodes, unlike the first embodiment in which the voltage Vs twice the sustain pulse voltage is applied to the X-electrode or Y-electrode in the optional reset period.

FIG. 9 shows drive waveforms in the first field and, more specifically, drive waveforms in one of a plurality of subfields of the first field. One subfield is divided into a reset period comprised of a full write period and full erase period, an address period, and a sustain discharge period.

The drive waveforms in the reset period and address period in FIG. 9 are the same as those shown in FIG. 1, and a repetitive description will be omitted.

In the sustain discharge period, a positive voltage Vs/2 and negative voltage (−Vs/2) are alternately applied to the sustain discharge electrodes (X- and Y-electrodes). The voltages applied to the X- and Y-electrodes have opposite polarities. That is, when the positive voltage Vs/2 is applied to the X-electrodes, the negative voltage (−Vs/2) is applied to the Y-electrodes. With this operation, the potential difference between the X-electrode and the Y-electrode corresponds to the sustain pulse voltage Vs for discharge between the X-electrode and the Y-electrode, so sustain discharge occurs between the sustain discharge electrodes (X- and Y-electrodes).

In this embodiment, in applying the last sustain pulse in the sustain discharge period, the voltage Vs twice the sustain pulse voltage is applied to one of the sustain discharge electrodes (X- and Y-electrodes), and the other electrode is set at ground level (0 V). FIG. 9 shows a case wherein the voltage Vs twice the sustain pulse voltage is applied to X-electrodes X1 and X2. Hence, discharge occurs between the X-electrodes X1 and X2 and Y-electrodes Y1 and Y2.

After that, both the sustain discharge electrodes (X- and Y-electrodes) are set at the ground level (0 V), and a pulse having a voltage Va is applied to an address electrode A. With this operation, self-erase discharge is performed between the address electrode A and the X-electrodes X1 and X2. At this time, the Y-electrodes Y1 and Y2 are at the ground level.

As described above, according to the third embodiment, the sustain pulse to be applied at the end of the sustain discharge period is replaced with the twice voltage Vs and applied whereby wall charges capable of self-erase discharge between the address electrode and one of the sustain discharge electrodes by the pulse with the voltage Va are formed on the address electrode by sustain discharge between the sustain discharge electrodes. After that, the pulse with the voltage Va is applied to the address electrode A to cause self-erase discharge between the address electrode and the other electrode, thereby removing the wall charges formed on the address electrode.

With this arrangement, since wall charges formed on the address electrode during the sustain discharge period can be removed by the sustain pulse applied at the end of the sustain discharge period, a cell to be turned on in accordance with display data can be accurately selected in the address period without forming any wall charges on the address electrode, and any degradation in drive margin or display quality of the plasma display device can be suppressed.

In addition, since the sustain pulse to be applied at the end of the sustain discharge period is replaced with the twice voltage Vs and applied, the wall charges formed on the address electrode can be reliably removed without changing the field or subfield structure.

In the above-described first and second embodiments, one subfield is divided into a reset period, address period, sustain discharge period, and optional reset period. However, one subfield may be divided into a reset period, address period, and sustain discharge period, and an optional reset period may be inserted between subfields. Additionally, in the above-described first and second embodiments, the optional reset period is prepared after the sustain discharge period in a subfield. However, the optional reset period may be prepared before the reset period in a subfield.

The above embodiments are mere examples of the present invention and should not be construed to limit the technical range of the present invention. That is, the present invention can be practiced in various forms without departing from its technical spirit and scope or major features.

As has been described above, according to the present invention, the erase step of erasing wall charges formed, by sustain discharge between sustain discharge electrodes, on an address electrode for selecting a display cell formed between the sustain discharge electrodes is prepared. Hence, a cell to be turned on in accordance with display data can be accurately selected without any influence of the wall charges formed by sustain discharge, and any degradation in drive margin or display quality of a plasma display device can be suppressed.

What is claimed is:

1. A method of driving a plasma display device applying a first voltage between sustain discharge electrodes so as to perform discharge in a display cell, comprising:

a reset operation including at least a full write operation;

an address operation of turning on/off said display cell in accordance with display data;

a sustain discharge operation of performing sustain discharge between said sustain discharge electrodes; and before said reset operation, a removal operation of removing wall charges formed, by said sustain discharge operation performed between said sustain discharge electrodes, on an address electrode for selecting said display cell.

2. The method according to claim 1, wherein said removal operation comprises a wall charge formation operation of applying a second voltage to at least one of said sustain discharge electrodes and a self-erase operation of applying a third voltage to said address electrode, and said second voltage is a voltage for forming, on said address electrode by sustain discharge performed between said sustain discharge electrodes, wall charges capable of self-erase discharge performed between said address electrode and at least one of said sustain discharge electrodes in said self-erase operation.

3. The method according to claim 2, wherein in said wall charge formation operation, said second voltage is applied to one of said sustain discharge electrodes, and the other electrode is set at ground level.

4. The method according to claim 2, wherein in said wall charge formation operation, said second voltage is applied to one of said sustain discharge electrodes, and then said second voltage is applied to the other electrode.

5. The method according to claim 1, wherein said removal operation is arranged between subfields, each subfield comprising a respective reset operation, a respective address operation, and a respective sustain discharge operation.

6. A method of driving a plasma display device, comprising applying a first voltage between sustain discharge electrodes so as to perform discharge in a display cell, wherein after a sustain discharge is performed between said sustain discharge electrodes, a second voltage, that is a voltage twice a power supply voltage, for generating a pulse for sustain discharge is applied to at least one of said sustain discharge electrodes, and during or after applying said second voltage, a third voltage is applied to an address electrode for selecting said display cell.

7. The method according to claim 6, wherein:

said sustain discharge electrodes comprise X-electrodes which are driven by a sustain discharge pulse simultaneously, and Y-electrodes which are driven by a sustain discharge pulse simultaneously and by a scanning pulse separately, and said second voltage is applied to the X-electrode.

8. The method according to claim 6, wherein:

said sustain discharge electrodes comprise X-electrodes which are driven by a sustain discharge pulse simultaneously, and V-electrodes which are driven by a sustain discharge pulse simultaneously and by a scanning pulse separately; and said second voltage is applied to the V-electrode.

9. The method according to claim 6, wherein:

said sustain discharge electrodes comprise X-electrodes which are driven by a sustain discharge pulse simultaneously, and V-electrodes which are driven by a sustain discharge pulse simultaneously and by a scanning pulse separately; and said second voltage is applied to the Y-electrode, and then, said second voltage is applied to the X-electrode.

10. The method according to claim 6, wherein:

said sustain discharge electrodes comprise X-electrodes which are driven by a sustain discharge pulse simultaneously, and V-electrodes which are driven by a sustain discharge pulse simultaneously and by a scanning pulse separately; and said second voltage is applied to the X-electrode, and then, said second voltage is applied to the V-electrode.

11. A method of driving a plasma display device comprising:

applying a first voltage between sustain discharge electrodes so as to perform discharge in a display cell, wherein;

a second voltage, that is a voltage twice a power supply voltage, for generating a pulse for sustain discharge is applied to at least one of said sustain discharge electrodes as a final pulse for sustain discharge performed between said sustain discharge electrodes, and during or after applying said second voltage, a third voltage is applied to an address electrode for selecting said display cell.

12. The method according to claim 11, wherein:

said sustain discharge electrodes comprise X-electrodes which are driven by a sustain discharge pulse simultaneously and Y-electrodes which are driven by a sustain discharge pulse simultaneously and by a scanning pulse separately; and said second voltage is applied to the X-electrode.

13. The method according to claim 11, wherein;

said sustain discharge electrodes comprise X-electrodes which are driven by a sustain discharge pulse simultaneously and V-electrodes which are driven by a sustain discharge pulse simultaneously and by a scanning pulse separately; and said second voltage is applied to the V-electrode.

14. The method according to claim 11, wherein;

said sustain discharge electrodes comprise X-electrodes which are driven by a sustain discharge pulse simultaneously, and Y-electrodes which are driven by a sustain discharge pulse simultaneously and by a scanning pulse separately; and said second voltage is applied to the Y-electrode, and then, said second voltage is applied to the X-electrode.

15. The method according to claim 11, wherein;

said sustain discharge electrodes comprise X-electrodes which are driven a by sustain discharge pulse simultaneously, and Y-electrodes which are driven by a sustain discharge pulse simultaneously and by a scanning pulse separately; and said second voltage is applied to the X-electrode, and then, said second voltage is applied to the Y-electrode.

16. A plasma display device applying a first voltage between sustain discharge electrodes so as to perform discharge in a display cell, comprising:

a control circuit applying a second voltage to at least one of said sustain discharge electrodes and applying a third voltage to an address electrode for selecting said display cell.

wherein said second voltage is a voltage which forms, on said address electrode by sustain discharge performed between the sustain discharge electrodes, wall charges capable of self-erase discharge between said address electrode and at least one of said sustain discharge electrodes by said third voltage.

17. A plasma display device applying a first voltage between sustain discharge electrodes so as to perform discharge in a display cell, comprising:

a control circuit, after a sustain discharge is performed between said sustain discharge electrodes, applying a second voltage, of a level twice a level of a power supply voltage, which generates a pulse producing a sustain discharge, to at least one of said sustain discharge electrodes, and during or after applying said second voltage, applying a third voltage to an address electrode for selecting said display cell.

18. A method of driving a plasma display device in which a first voltage is applied between sustain discharge electrodes so as to perform a discharge in a selected display cell, comprising:

removing wall charges, formed on an address electrode to select said display cell, by a sustain discharge performed between said sustain discharge electrodes.

19. The method according to claim 18, wherein said removing comprises;

applying a second voltage to at least one of said sustain discharge electrodes to form the wall charges and applying a third voltage to said address electrode to produce a self-erase discharge, and said second voltage forms, on said address electrode by a sustain discharge performed between said sustain discharge electrodes, wall charges which undergo self-erase discharge, between said address electrode and at least one of said sustain discharge electrodes, in said self-erase discharge.

20. The method according to claim 19, wherein said removing comprises applying the second voltage to one of said sustain discharge electrodes and setting the other of said sustain electrodes at ground level.

21. The method according to claim 20, wherein said second voltage is applied to one of said sustain discharge electrodes, and subsequently to the other electrode.

22. The method according to claim 18, wherein said removing is performed between subfields, each subfield comprising reset, address, and sustain discharge intervals.

23. A method of driving a plasma display device wherein a first voltage is applied between sustain discharge electrodes so as to perform a sustain discharge in a display cell, comprising:

after a sustain discharge between said sustain discharge electrodes, applying a second voltage, of a voltage level twice that of a power supply voltage level, to generate a pulse for sustain discharge applied to at least one of said sustain discharge electrodes; and during or after applying said second voltage, applying a third voltage to an address electrode to select said display cell.

24. A method of driving a plasma display device in which a first voltage is applied between sustain discharge electrodes so as to perform a discharge in a display cell, comprising:

applying a second voltage of a voltage level twice that of a power supply voltage level, to generate a pulse for sustain discharge, to at least one of said sustain discharge electrodes, as a final pulse producing a sustain discharge between said sustain discharge electrodes; and during or after applying said second voltage, applying a third voltage to an address electrode to select said display cell.

* * * * *

UNITED STATES PATENT AND TRADEMARK OFFICE

CERTIFICATE OF CORRECTION

PATENT NO. : 6,867,552 B2
APPLICATION NO. : 09/986949
DATED : March 15, 2005
INVENTOR(S) : Takahiro Takamori et al.

It is certified that error appears in the above-identified patent and that said Letters Patent is hereby corrected as shown below:

Column 16:

Line 57, (claim 8, line 4) change “V” to --Y--;

Line 60, (claim 8, line 7) change “V” to --Y--;

Line 64, (clam 9, line 4) change “V” to --Y--.

Column 17:

Line 6, (claim 10, line 4) change “V” to --Y--;

Line 10, (claim 10, line 8) change “V” to --Y--;

Line 34, (claim 13, line 4) change “V” to --Y--;

Line 37, (claim 13, line 7) change “V” to --Y--;

Line 48, (claim 15, line 3) change “a by” to --by a --;

Line 49, (claim 15, line 4) delete “,”.

Signed and Sealed this

Twenty-ninth Day of August, 2006

JON W. DUDAS
*Director of the United States Patent and Trademark Office*